US011027448B2

(12) United States Patent
Mulder

(10) Patent No.: US 11,027,448 B2
(45) Date of Patent: Jun. 8, 2021

(54) APPARATUS AND METHOD FOR CONVERTING A SHEET INTO A CONTINUOUS STRIP

(71) Applicant: VMI Holland B.V., Epe (NL)

(72) Inventor: Gerben Mulder, Epe (NL)

(73) Assignee: VMI HOLLAND B.V.

( * ) Notice: Subject to any disclaimer, the term of this patent is extended or adjusted under 35 U.S.C. 154(b) by 96 days.

(21) Appl. No.: 16/090,000

(22) PCT Filed: Mar. 30, 2017

(86) PCT No.: PCT/NL2017/050194
§ 371 (c)(1),
(2) Date: Sep. 28, 2018

(87) PCT Pub. No.: WO2017/171545
PCT Pub. Date: Oct. 5, 2017

(65) Prior Publication Data

US 2019/0111578 A1 Apr. 18, 2019

(30) Foreign Application Priority Data

Apr. 1, 2016 (NL) ..... 2016534

(51) Int. Cl.
*B26D 3/00* (2006.01)
*B26D 5/00* (2006.01)
(Continued)

(52) U.S. Cl.
CPC ..... *B26D 3/003* (2013.01); *B01F 3/20* (2013.01); *B01F 7/082* (2013.01); *B26D 5/00* (2013.01);
(Continued)

(58) Field of Classification Search
CPC .... Y10S 83/951; Y10T 83/04; Y10T 83/0467; Y10T 83/0558; Y10T 83/0572;
(Continued)

(56) References Cited

U.S. PATENT DOCUMENTS 3,503,289 A * 3/1970 Friberg ..... B26D 1/245 83/861
3,738,580 A * 6/1973 Harris ..... B02C 23/02 241/30
(Continued)

FOREIGN PATENT DOCUMENTS

CN 1180009 12/2004 ..... B29D 30/06
CN 1579749 2/2005 ..... B29D 30/38
(Continued)

OTHER PUBLICATIONS

International Search Report and Written Opinion issued in application No. PCT/NL2017/050194, dated Sep. 18, 2017 (14 pgs).
(Continued)

*Primary Examiner* — Phong H Nguyen
(74) *Attorney, Agent, or Firm* — Hayes Soloway P.C.

(57) ABSTRACT

Disclosed is an apparatus and a method for converting a sheet into a continuous strip, wherein the sheet has a sequence of cuts extending in a cutting direction transversely across the sheet with respect to the longitudinal direction to form a plurality of interconnected sheet sections, wherein the continuous strip has zig-zag sections, wherein the sheet sections are arranged to be pulled apart in a feeding direction to form the zig-zag sections, wherein the apparatus includes a separator device with a retaining device for retaining an upstream sheet section with respect to a consecutive downstream sheet section in the feeding direction and a sensor device for detecting the pulling apart of the downstream sheet section from the upstream sheet section.

24 Claims, 16 Drawing Sheets

(51) Int. Cl.

| | |
|---|---|
| ***B01F 3/20*** | (2006.01) |
| ***B01F 7/08*** | (2006.01) |
| ***B26D 7/01*** | (2006.01) |
| ***B26F 3/02*** | (2006.01) |

(52) U.S. Cl.
CPC ..... *B26D 5/007* (2013.01); *B26D 7/015* (2013.01); *B26F 3/02* (2013.01); *B01F 2215/0049* (2013.01)

(58) Field of Classification Search
CPC ..... Y10T 83/715; Y10T 83/2074; Y10T 83/2094; Y10T 83/2196; Y10T 83/4653; Y10T 83/4838; Y10T 83/4836; Y10T 83/664; Y10T 83/6643; Y10T 83/6648; Y10T 83/887; Y10T 225/12; Y10T 225/16; Y10T 225/18; Y10T 225/30; Y10T 225/321; Y10T 225/393; B26D 3/003; B26D 2005/002; B26D 5/00; B26D 5/007; B26D 7/015; B26D 7/01; B26D 7/06; B26D 7/0641; B26D 7/18; B26D 7/1827; B26D 7/1836; B01F 3/02; B01F 7/082; B01F 2215/0049; B26F 3/02; B26F 3/00
USPC ..... 241/24.1, 24.17–24.19
See application file for complete search history.

(56) References Cited

U.S. PATENT DOCUMENTS

| | | | | |
|---|---|---|---|---|
| 3,762,250 | A * | 10/1973 | Huskey | B26D 1/035 83/27 |
| 3,975,974 | A | 8/1976 | Harris | 83/1 |
| 3,993,724 | A * | 11/1976 | Takamatsu | B29D 5/08 425/292 |
| 4,016,320 | A | 4/1977 | Harris | 428/131 |
| 4,181,055 | A | 1/1980 | Miyata | B27L 5/08 |
| 4,782,678 | A * | 11/1988 | Reimschissel | B21D 28/06 192/127 |
| 7,078,449 | B2 | 7/2006 | Pagano et al. | 524/264 |
| 8,561,980 | B2 | 10/2013 | Demmeler et al. | 271/124 |
| 2005/0160890 | A1 | 7/2005 | Titz | 83/13 |
| 2016/0008181 | A1 | 1/2016 | Wood et al. | A61F 13/15 |

FOREIGN PATENT DOCUMENTS

| | | | |
|---|---|---|---|
| CN | 1640634 | 7/2005 | B26D 7/20 |
| CN | 103596743 | 2/2014 | B29C 47/92 |
| EP | 2 714 368 | 10/2015 | B29C 47/92 |
| JP | 2004-262194 | 9/2004 | B29C 47/10 |
| JP | 2005125701 | 5/2005 | |
| JP | 2007-307871 | 11/2007 | |
| JP | 2013180385 | 9/2013 | |
| RU | 2 356 821 | 12/2007 | B65H 3/06 |
| SU | 803852 | 2/1978 | B23D 15/06 |
| WO | WO2014/019619 | 2/2014 | B29D 7/10 |

OTHER PUBLICATIONS

Taiwan Search Report issued in related Application Serial No. 106111104, dated Jul. 8, 2020 (1 pg).
Decision to Grant issued in corresponding Russian Patent Application serial No. 2018133192/05, dated May 28, 2020 with machine translation (17 pages).
Chinese Official Action issued in related Chinese Patent Application Serial No. 201780021852.0, dated Mar. 2, 2020 (13 pages).
Chinese Search Report issued in related Chinese Patent Application Serial No. 201780021852.0, dated Feb. 22, 2020 (3 pages).
Japanese Official Action issued in related Application Serial No. 2019-503185, dated Nov. 20, 2020 with machine translation (5 pgs).
Japanese Decision to Grant issued in related Application Serial No. 2019-503185, dated Mar. 17, 20201 with machine translation (4 pgs).

* cited by examiner

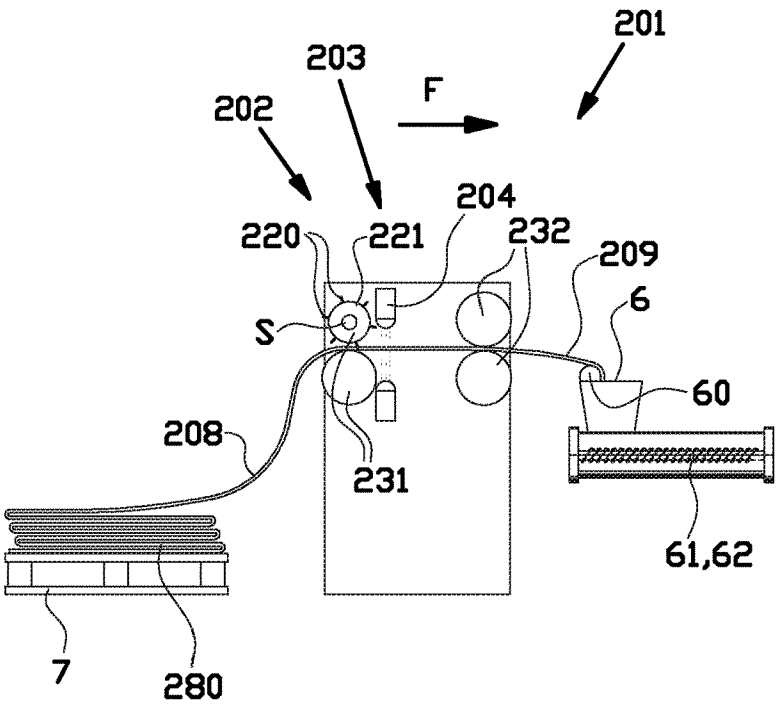
FIG. 4
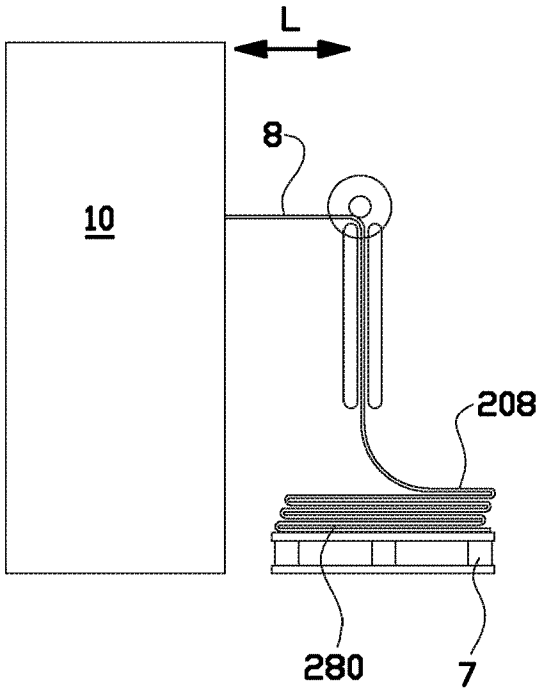

APPARATUS AND METHOD FOR CONVERTING A SHEET INTO A CONTINUOUS STRIP

BACKGROUND

The invention relates to an apparatus and a method for converting a sheet into a continuous strip.

U.S. Pat. No. 4,016,320 A discloses an apparatus for cutting sheet stock of uncured rubber into continuous strip stock. The apparatus comprises a rotary cutter with a plurality of alternatingly recessed blades so that each cutting edge effectively starts at a respective end of the cutter and terminates somewhat short of the respective other end thereof. In operation, the sheet stock is fed into the assembly and is there subjected to the cutting action of the blades. That sheet stock which has passed the cutter is transported away by a further suitable conveyor arrangement and is seen to be provided with a plurality of obliquely oriented, parallel, transverse slits extending in an alternating sequence from opposite side edges of the sheet and each terminating short of the respective other side edge of the sheet. The cut sheet stock is thus composed of a continuous zig-strap strip. The apparatus is associated with an extruder that is used to extrude tread slabs or strips for tires. Once the leading end of the strip stock has been fed into the extruder, the pulling force extruder by the latter on the strip automatically tears open the sheet stock into the zig-zag strip form.

In practice, the tearing open of the sheet stock into the zig-zag strip form is inconsistent. Ideally, the sheet stock is torn open evenly, releasing one zig-zag length at a time. More frequently however, several zig-zags of the strips clutter together and tear off as a group. This cluttering can potentially clog the extruder. Occasionally, the zig-zag strip is completely torn off, resulting in a discontinuous strip.

It is an object of the present invention to provide an apparatus and a method for converting a sheet into a continuous strip, wherein the continuity and/or the consistency of the strip can be improved.

SUMMARY OF THE INVENTION

According to a first aspect, the invention provides an apparatus for converting a sheet of elastomeric material into a continuous strip, wherein the sheet has a longitudinal direction, a first longitudinal edge, a second longitudinal edge and a sequence of cuts extending in a cutting direction transversely across the sheet with respect to the longitudinal direction, wherein the cuts in the sequence alternately extend from one of the longitudinal edges towards and terminate short of the other of the longitudinal edges to form a plurality of interconnected sheet sections, wherein the continuous strip has a plurality of interconnected zig-zag sections, wherein the sheet sections are arranged to be pulled apart in a feeding direction to form the zig-zag sections of the continuous strip, wherein the apparatus comprises a separator device that is arranged for receiving the sheet with the longitudinal direction thereof parallel or substantially parallel to the feeding direction, wherein the separator device comprises a retaining device for retaining an upstream sheet section with respect to a consecutive downstream sheet section in the feeding direction and a sensor device for detecting the pulling apart of the downstream sheet section from the upstream sheet section.

By detecting the pulling apart of the downstream sheet section from the upstream sheet section, it can be established whether the two consecutive sheet sections are actually pulled apart before the sheet is fed further into the separator device. In particular, it can be detected whether the pulling apart takes place appropriately or whether several sheet sections remain stuck together. In the latter case, appropriate action can be taken, e.g. by an operator. Hence, the continuity and/or the consistency of the continuous strip can be improved.

In a preferred embodiment thereof the sensor device comprises one or more central sensors that are arranged for detecting the pulling apart of the downstream sheet section from the upstream sheet section at a central area of the sheet between the longitudinal edges. With each subsequent downstream sheet section being pulled apart in alternating directions from one of the longitudinal edges towards the other, the one or more central sensors can detect the pulling apart in either direction.

Additionally or alternatively, the sensor device may comprise a first side sensor that is arranged for detecting the pulling apart of the downstream sheet section from the upstream sheet section at or near the first longitudinal edge of the sheet. In addition to the first side sensor, the sensor device preferably comprises a second side sensor that is arranged for detecting the pulling apart of the downstream sheet section from the upstream sheet section at or near the second longitudinal edge of the sheet. The side sensors can detect the initial pulling apart at or near the longitudinal edges of the sheet.

In a further embodiment of the invention, the retaining device is arranged for retaining the upstream sheet section when none of the one or more sensors detects the pulling apart of the downstream sheet section from the upstream sheet section. Hence, the upstream sheet section can be retained until the pulling apart is detected, thereby preventing that the sheet sections remain stuck together.

In an embodiment the retaining device is arranged for releasing the upstream sheet section when at least one of the one or more sensors detects the pulling apart of the downstream sheet section from the upstream sheet section. When the pulling apart of the downstream sheet section is detected, the release allows the upstream sheet section to take the place of the downstream sheet section in a next cycle of the pulling apart.

In a further embodiment including the aforementioned one or more central sensors and the side sensors, the apparatus further comprises a control unit, wherein the control unit is electronically connected to the retaining device, the first side sensor, the one or more central sensors and the second side sensor for controlling the retaining device to retain the upstream sheet section until one of the two side sensors detects the pulling apart of the downstream sheet section from the upstream sheet section. Hence, the upstream sheet section can be retained until the initial pulling apart is detected, thereby preventing that the sheet sections remain stuck together.

In a preferred embodiment thereof the control unit is arranged for controlling the retaining device to retain the upstream sheet section until one of the two side sensors and at least one of the one or more central sensors detects the pulling apart of the downstream sheet section from the upstream sheet section. Hence, the upstream sheet section can be retained until the pulling apart is detected not only at the longitudinal edges of the sheet, but also in the central area of the sheet, thereby ensuring that at least a substantial part of the downstream sheet section has separated from the upstream sheet section.

In a further embodiment thereof the control unit is arranged for controlling the retaining device to release the upstream sheet section when one of the two side sensors is the only sensor that has not yet detected the pulling apart. The control unit can derive from this condition that the downstream sheet section has been substantially separated from the upstream sheet section apart from its connection at the opposite longitudinal edge. At this moment the sheet can be released to prevent that the connection between the downstream sheet section and the upstream sheet section is interrupted and to ensure that the continuous strip remains connected to the upstream sheet section.

In a further embodiment the control unit is further arranged for controlling the retaining device to retain the upstream sheet section if both side sensors and the one or more central sensors simultaneously detect the pulling apart. This condition is indicative of a situation in which the continuous strip is no longer connected to the upstream sheet section. The process can be interrupted and the control unit can take appropriate action, e.g. alarming an operator.

In an embodiment the control unit is further arranged for controlling the retaining device to release the sheet to allow the upstream sheet section to advance over a predetermined feeding distance in the feeding direction, wherein the control unit is arranged for controlling the retaining device to again retain the sheet once the upstream sheet section has advanced over the predetermined feeding distance. Preferably, the predetermined feeding distance is equal or substantially equal to the width of a sheet section in the feeding direction. This allows the upstream sheet section to take the place of the downstream section to become the downstream sheet section of a subsequent pair of two directly consecutive sheet sections in a next cycle of the pulling apart.

In a further embodiment the apparatus further comprises an extruder that has a controllable infeed rate, wherein the control unit is electronically connected to the extruder for controlling the infeed rate of the extruder based on the detection of the pulling apart by the one or more sensors. Thus, the infeed rate of the extruder can be matched to the rate at which the sheet sections are pulled apart to ensure uniform feeding of the continuous strip into the extruder.

In an exemplary embodiment the one or more sensors are arranged on a detection line that extends parallel or substantially parallel to the cutting direction. In a preferred embodiment thereof the cutting direction extends perpendicular to the feeding direction. Alternatively, the cutting direction extends obliquely with respect to the feeding direction. Hence, the sensors can accurately detect the pulling apart along the same direction in which the cuts extend across the sheet.

In an alternative embodiment of the apparatus according to the first aspect of the invention, the apparatus further comprises an extruder that is arranged to pull on the continuous strip in the feeding direction, wherein the sensor device comprises a dancer roller that is arranged to push down onto the continuous strip between the retaining device and the extruder, wherein the retaining of the upstream sheet section by the retaining device in combination with the pulling of the extruder causes the dancer roller to move upwards with the continuous strip and wherein the pulling apart of the downstream sheet section from the upstream sheet section causes the dancer roller to move downwards with the continuous strip, wherein the sensor device further comprises a sensor that is arranged for detecting the movement and/or position of the dancer roller.

The position and/or movement of the dancer roller can be used as a reliable indicator of the pulling apart, in particular because the newly torn off sheet section forms a next zig-zag section of the continuous strip, consequently increasing the length of said continuous strip between the retaining device and the extruder, which increase in length can directly influence the position of the dancer roller.

In an embodiment thereof the sensor is arranged for detecting the passing of the dancer roller through a certain detection position. Said detection position may correspond to the position of the dancer roller near or in its highest position prior to the pulling apart or near or in its lowest position during or after the pulling apart.

In an alternative embodiment thereof the sensor device comprises an arm that is rotatable with respect to an arm axis, wherein the dancer roller is arranged on said arm spaced apart from said arm axis for rotation about said arm axis, wherein the sensor is an angular displacement sensor for detecting the angular displacement of the arm about the arm axis. The angular displacement of the arm can be a reliable indicator for the movement and/or the position of the dancer roller.

In an embodiment the apparatus further comprises a control unit, wherein the control unit is electronically connected to the retaining device, the sensor device and the extruder for controlling the retaining device to retain the upstream sheet section until the sensor detects the upward and/or downward movement of the dancer roller when the extruder is pulling. Thus, the sheet is only released when the movement of the dancer roller, indicative of the pulling apart, is detected.

In an embodiment thereof the control unit is further arranged for controlling the retaining device to retain the upstream sheet section if the sensor does not detect the upward and/or downward movement of the dancer roller when the extruder is pulling. Thus, the sheet is only released when the movement of the dancer roller, indicative of the pulling apart, is detected.

In an embodiment the apparatus comprises a cutting device that is arranged for receiving the sheet with the longitudinal direction thereof parallel or substantially parallel to the feeding direction and for cutting transversely across the sheet with respect to the feeding direction to create the sequence of cuts.

In a preferred embodiment thereof the cutting device is arranged upstream of the separator device, wherein the apparatus comprises one or more carriers for storing the sheet with cut sheet sections between the cutting device and the separator device. Hence, the sheet can already be provided with the sequence of cuts prior to the sheet entering the separator device.

Alternatively the separator device comprises the cutting device. Hence, the sheet can be provided with the sequence of cuts at or in the separator device.

Preferably, the retaining device comprises the cutting device. The retaining device can therefore both cut and retain the cut sheet sections.

Alternatively, the retaining device is arranged downstream of the cutting device in the feeding direction. By having a separate retaining device, the cutting device and the retaining device can be optimized for their respective functions. In particular, the retaining device can be placed as close as possible to or at the upstream section during the pulling apart.

In an embodiment the cutting device is arranged for creating a next cut in the sequence of cuts with each release of the retaining device. Thus, the next cut is only created when a downstream sheet section has successfully been pulled apart from an upstream sheet section. The cutting process can thus be fully dependent on the pulling apart.

In an embodiment the cutting device comprises one or more blades extending in or substantially parallel to the cutting direction. Said blades can consecutively create each cut in the sequence of cuts.

In a further embodiment thereof the one or more blades are regularly recessed and/or intermittent along their lengths in the cutting direction. The recesses in the blades or the intermittent blades can create incomplete or intermittent cuts in the sheet, resulting in small bridges between the downstream sheet section and the upstream sheet section. The bridges can prevent that the sheet already falls apart along the cuts prior to the pulling apart. This embodiment can be particularly useful when the sheet is temporarily stored between the cutting and the pulling apart.

In an embodiment the apparatus comprises a rail extending in a translation direction transverse or perpendicular to the feeding direction, wherein the retaining device is arranged to be mounted on a carriage that is movable with respect to said rail in the translation direction. The position of the retaining device can thus be adapted to variations in the width of the sheet during the feeding into the separator device.

In a further embodiment thereof the sheet is arranged to be fed into the separator device alternately from a first stack and a second stack which are placed adjacent to each other in the translation direction, wherein the rail is arranged to extend in front of both stacks, wherein the retaining device is alternately movable between a first position in front of the first stack and a second position in front of the second stack in the feeding direction. The retaining device can thus be quickly alternated between the two stacks to allow restocking of depleted stacks.

In an embodiment the sheet is supplied from a stack into the separator device, wherein the apparatus comprises a stack sensor upstream of the separator device in the feeding direction for detecting an interruption in the sheet between the stack and the separator device and/or for detecting a depletion of the stack. This early detection of the depletion of the stack allows for a quick changeover to a new stack to minimize downtime of the apparatus.

According to a second aspect, the invention provides an apparatus for preparing a sheet of elastomeric material for conversion into a continuous strip, wherein the sheet has a longitudinal direction, a first longitudinal edge, a second longitudinal edge, wherein the apparatus comprises a cutting device that is arranged for receiving the sheet with the longitudinal direction thereof parallel or substantially parallel to the feeding direction and for cutting transversely across the sheet with respect to the feeding direction to create a sequence of cuts extending in a cutting direction transversely across the sheet with respect to the longitudinal direction, wherein the cuts in the sequence alternately extend from one of the longitudinal edges towards and terminate short of the other of the longitudinal edges to form a plurality of interconnected sheet sections, wherein the cutting device comprises one or more blades extending in or substantially parallel to the cutting direction, wherein the one or more blades are regularly recessed and/or intermittent along their lengths in the cutting direction.

The recesses in the blades or the intermittent blades can create incomplete or intermittent cuts in the sheet, resulting in small bridges between the downstream sheet section and the upstream sheet section. The bridges can prevent that the sheet already falls apart along the cuts prior to the pulling apart. This embodiment can be particularly useful when the sheet is temporarily stored between the cutting and the pulling apart.

In a first embodiment thereof the cutting direction extends perpendicular to the feeding direction. In a second, alternative embodiment thereof the cutting direction extends obliquely with respect to the feeding direction.

According to a third aspect, the invention provides a method for converting a sheet of elastomeric material into a continuous strip with the use of the apparatus according to the first aspect of the invention, wherein the method comprises the steps of: creating the sequence of cuts in the sheet to form the interconnected sheet sections, receiving the sheet in the separator device with the longitudinal direction of the sheet parallel or substantially parallel to the feeding direction, pulling the sheet sections apart in the feeding direction while retaining an upstream sheet section with respect to a consecutive downstream sheet section in the feeding direction to form the zig-zag sections of the continuous strip, and detecting the pulling apart of the downstream sheet section from the upstream sheet section with the sensor device.

It will be apparent to one skilled in the art that the method and its embodiments have the same advantages as the corresponding features of the apparatus. The advantages are therefore not repeated hereafter.

In an embodiment of the method the sensor device comprises one or more sensors. The one or more sensors can be used to accurately detect the separation between the sheet sections.

In an embodiment of the method the upstream sheet section is retained when none of the one or more sensors detects the pulling apart of the downstream sheet section from the upstream sheet section.

In an embodiment thereof the pulling apart is interrupted and/or an alarm signal is given when none of the one or more sensors detects the pulling apart of the downstream sheet section from the upstream sheet section within a predetermined time-limit. These conditions can be indicative of sheet sections sticking together or an interruption in the continuous strip. Appropriate action can be taken to correct the problem.

In a further embodiment of the method the upstream sheet section is released when at least one of the one or more sensors detects the pulling apart of the downstream sheet section from the upstream sheet section.

Preferably, the one or more sensors detect the pulling apart of the downstream sheet section from the upstream sheet section at a central area of the sheet between the longitudinal edges, at or near the first longitudinal edge of the sheet and at or near the second longitudinal edge of the sheet.

In an embodiment thereof the upstream sheet section is retained until the pulling apart of the downstream sheet section from the upstream sheet section is detected at or near one of the two longitudinal edges of the sheet.

In a further embodiment thereof the upstream sheet section is retained until the pulling apart of the downstream sheet section from the upstream sheet section is detected at or near one of the two longitudinal edges of the sheet and at the central area of the sheet.

In an embodiment of the method the upstream sheet section is retained when the pulling apart is simultaneously detected at or near both longitudinal side edges and the central area of the sheet.

In an alternative embodiment of the method the apparatus further comprises an extruder that pulls on the continuous strip in the feeding direction, wherein the sensor device comprises a dancer roller that pushes down onto the continuous strip between the retaining device and the extruder and a sensor for detecting upward and/or downward movement of the dancer roller, wherein the detection of the pulling apart comprises the steps of retaining the upstream sheet section by the retaining device in combination with the pulling of the extruder, pulling apart the downstream sheet section from the upstream sheet section, and detecting the resulting upward and/or downward movement, respectively, of the dancer roller.

In an embodiment thereof the upstream sheet section is retained until a downward movement of the dancer roller is detected. The downward movement can be a reliable indicator of the pulling apart. By only releasing the upstream sheet section until the pulling apart is detected, it can be ensured that the pulling apart takes place before a next cycle of the pulling apart is initiated.

In an embodiment thereof the pulling apart is interrupted and/or an alarm signal is given when a downward movement is not followed by an upward movement of the dancer roller within a predetermined time limit and/or when the upward movement is not followed by a downward movement within a predetermined time limit. These conditions can be indicative of sheet sections sticking together or an interruption in the continuous strip. Appropriate action can be taken to correct the problem.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached schematic drawings, in which:

FIG. 4 shows a side view of a further alternative apparatus according to a third embodiment of the invention;

DETAILED DESCRIPTION OF THE INVENTION

Figure 1A:
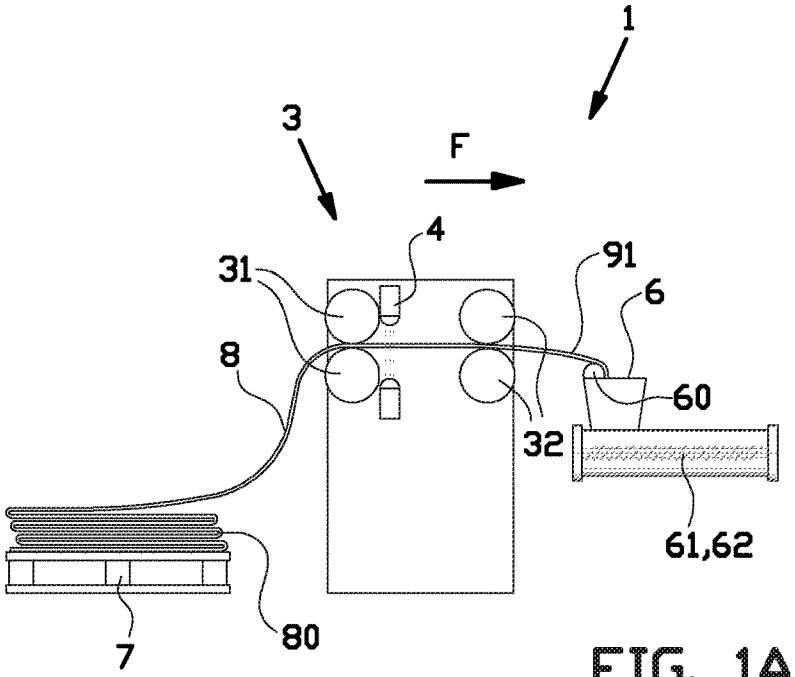
FIG. 1A shows a side view of an apparatus according to a first embodiment of the invention for converting a sheet into a continuous strip.

FIGS. 1A, 1B and 3A-3D show an apparatus 1 for converting a sheet 8 into a continuous strip 9 according to a first exemplary embodiment of the invention. As shown in FIG. 1A, the apparatus 1 comprises a source or batch-off 10 for supplying the sheet 8 into the apparatus 1, a cutting device 2 for cutting the sheet 8, a separator device 3 form the sheet 8 into the continuous strip 9 and an extruder 6 for taking in and mixing the continuous strip 9 into an extrudate (not shown). Between one or more of the aforementioned components, the sheet 8 is stacked on a suitable carrier 7, e.g. a pallet. Several carriers 7 may be provided to store and/or supply several stacked sheets 8, depending on the capacity and/or the number of extruders 6.

Figure 3A:
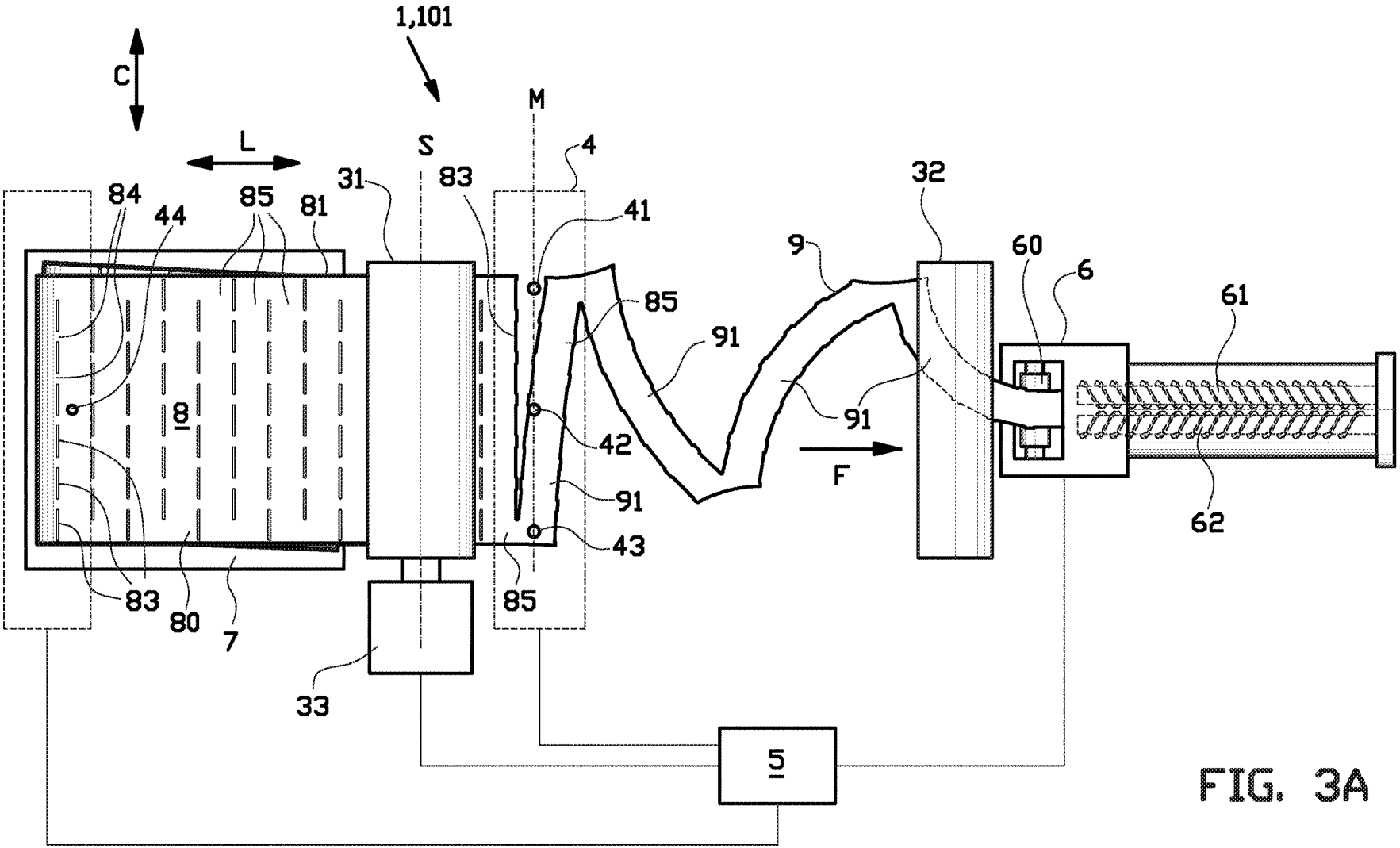
FIGS. 3A-3D show top views of the apparatus according to FIG. 1 during several steps of converting the sheet into the continuous strip.

Each sheet 8 consists of or comprises a raw or uncured elastomeric material, preferably rubber or a rubber-like material, which is suitable for manufacturing tire components, such as treads, breaker plies or body plies. As best seen in FIG. 3A, the sheet 8 has a longitudinal direction L and a first longitudinal edge 81 and a second longitudinal edge 82 extending parallel or substantially parallel to said longitudinal direction L. As shown in FIG. 1A, each sheet 8 has a considerable length that has been folded back onto itself several times to form a bale or a stack 80 of layers on top of one of the carriers 7. At the separator device 3, a free end of the sheet 8 at the top of the stack 80 is fed through the separator device 3 and towards the extruder 6 in a feeding direction F parallel to the longitudinal direction L of the sheet 8.

Ideally, each stack 80 comprises a single sheet 8 that is continuous from top to bottom. In practice however, the raw elastomeric material of the sheet 8 may be inconsistent and/or interrupted somewhere in the stack 80, resulting in an inconsistent and/or discontinuous feed into the cutting device 2. Furthermore, in practice, the layers of the stack 80 are not stacked neatly on top of each other. Instead, some of the layers of the stack 80 may be shifted randomly with respect to the directly adjacent layers. The apparatus 1 according to the invention deals with these inconsistencies in the supply of the raw material in a manner that will be described in more detail hereafter.

The cutting device 2 is arranged for slitting or cutting transversely across the sheet 8 with a sequence of alternating slits or cuts 83 to form a plurality of consecutive sheet sections 85 as shown in FIG. 3A. The cuts 83 alternately extend from one of the longitudinal edges 81, 82 towards and terminating short of the other of the longitudinal edges 81, 82. Hence, the cuts 83 do not extend fully across the sheet 8 but leave the sheet 8 partially intact to form connections alternately at the opposite longitudinal edges 81, 82. In this exemplary embodiment, the cuts 83 are intermittent, meaning that optional small bridges 84 are left between the directly consecutive sheet sections 85 to prevent that the sheet sections 85 unintentionally tear-off. The sheet sections 85 thus remain interconnected while the sheet 8 is stacked 80 on a carrier 7. The bridges 84 are not necessary if the sheet is directly processed in the separator device 3 after cutting, which will be illustrated by an alternative embodiment later in this description. The sheet sections 85 are arranged to be torn open or pulled apart in the feeding direction F by the separator device 3 along the cuts 83 to form zig-zag sections 91 of the continuous strip 9.

Figure 1B:
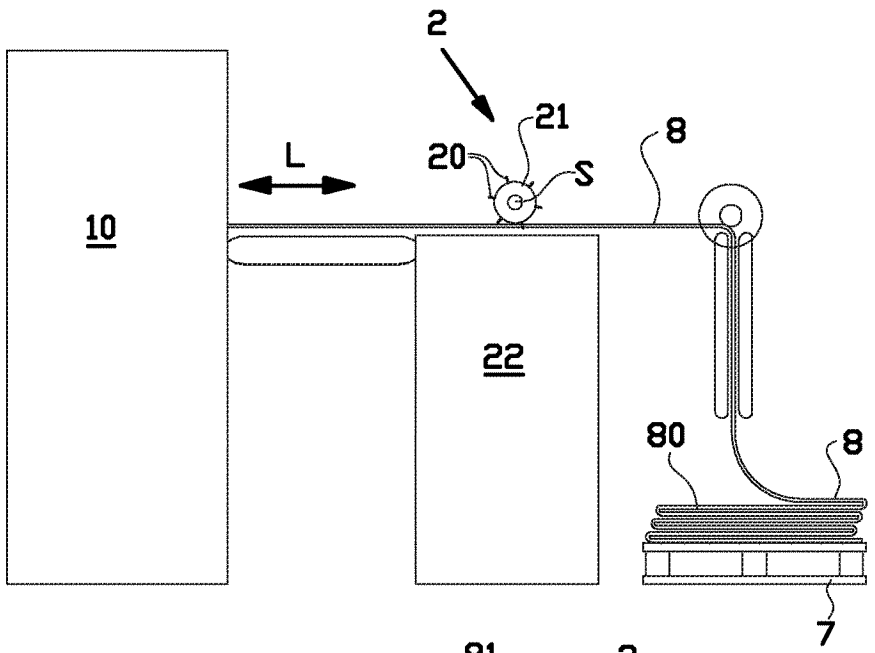
FIG. 1B shows a detail of the apparatus according to FIG. 1 in top view.

As best seen in FIG. 1B, the cutting device 2 comprises one or more blades or knives 20 for creating the cuts 83 in the sheet 8. In this exemplary embodiment, the cutting device 2 is a rotary cutter comprising a plurality of the knives 20 which are distributed evenly around the circumference of a cylindrical body 21. The cylindrical body 21 is rotatable about a rotation axis S that extends perpendicular or substantially perpendicular to the longitudinal direction L and/or the feeding direction F. The knives 20 extend in a cutting direction C that is parallel or substantially parallel to the rotation axis S. Alternatively, the knives 20 may extend in a different cutting direction C, as will be illustrated by an alternative embodiment later in this description. The knives 20 extend alternately from one end of the cylindrical body 21 towards and terminate short of the other end of the cylindrical body 21. Each knife 20 thus effectively starts at a respective end of the cylindrical body 21 and creates a corresponding cut 83 in the sheet 8 towards yet short of the opposite end of the cylindrical body 21. The resulting cuts 83 extend alternately from one longitudinal edge 81, 82 and terminating short of the other longitudinal edge 81, 82 of the sheet 8. In this exemplary embodiment, the cutting edges of the knives 20 are intermittent and/or regularly recessed along their length in the cutting direction C to generate and/or leave out the previously discussed bridges 84 in the sheet 8.

As shown in FIGS. 1A and 1B, the apparatus 1 according to the first embodiment of the invention is arranged for receiving the sheet 8 from the source 10, cutting the sheet 8 at the cutting device 2 in accordance with the previously discussed process for creating the sheet sections 85 and for subsequently storing the sheet 8 in a stack 80 on a suitable carrier 7. The carrier 7 is stored to allow the raw material of the sheet 8 to settle. The carrier 7 or another previously stored carrier 7 with the cut sheet 8 can subsequently be positioned near the separator device 3 for forming the cut sheet 8 into the continuous strip 9, before ultimately feeding the continuous strip 9 into the extruder 6.

Figure 2:
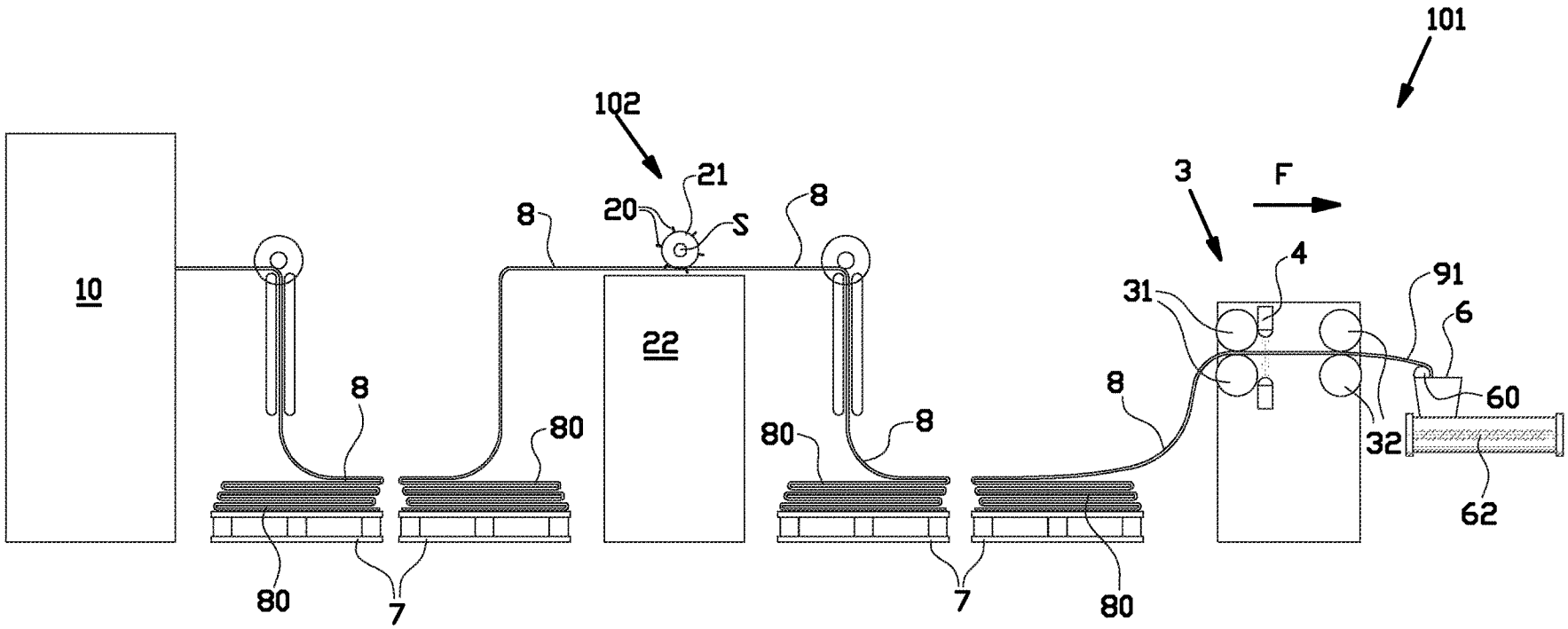
FIG. 2 shows a side view of an alternative apparatus according to a second embodiment of the invention.

FIG. 2 shows a slightly different apparatus 101 according to a second embodiment of the invention, in which the sheet 8 is supplied from the source 10 directly onto a suitable carrier 7. The carrier 7 is stored to allow the raw material of the sheet 8 to settle. The carrier 7 or another previously stored carrier 7 is subsequently positioned near the cutting device 102 to cut the sheet 8 in accordance with the previously discussed process. The thus obtained sheet 8 is provided with the sheet sections 85. The sheet 8 is again stored in a stack 80 on a suitable carrier 7. The carrier 7 or another previously stored carrier 7 with the cut sheet 8 can subsequently be positioned near the separator device 3 for forming the cut sheet 8 into the continuous strip 9, before ultimately feeding the continuous strip 9 into the extruder 6.

It will be apparent to one skilled in the art that many variations in the intermediate storage of the stacks 80 are possible which would yet be encompassed by the scope of the present invention. The cutting of the sheet 8 for storage on a suitable carrier 7 and the subsequent handling of the stored carrier 7 can be considered as separate phases of the process, which are subject of the present application both dependently and independently.

The extruder 6 is provided with an infeed roller 60 that guides the continuous strip 9 into the extruder 6. The extruder 6 comprises one or more screws 61, 62 that pull the zig-zag sections 91 of the continuous strip 9 into the extruder 6 at a certain infeed rate. As the extruder 6 pulls on said zig-zag sections 91, a subsequent sheet section 85 of the sheet 8—between the cutting device 2 and the extruder 6—is gradually separated from the other sheet sections 85 of the sheet 8 under the pulling action of the extruder 6.

The apparatuses 1, 101 as shown in FIGS. 1, 2 and 3A-3D comprise a similar or identical separator device 3 which will be described in more detail hereafter.

Figure 1B:
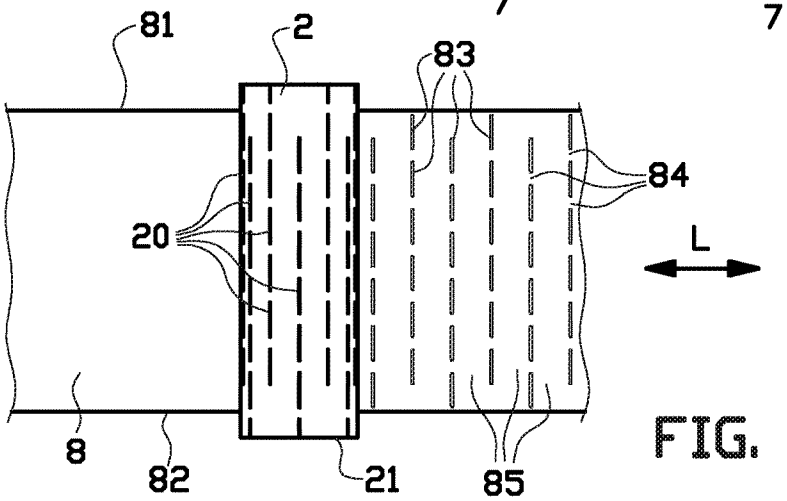

As shown in FIGS. 1 and 2, the separator device 3 comprises a retaining device 31 for retaining one or more sheet sections 85 of the sheet 8 and a guiding member 32 downstream of said retaining device 31 in the feeding direction F for guiding the continuous strip 9 into the extruder 6. In this example, both the retaining device 31 and the guiding member 32 are provided with or formed by two rollers which present a bite that guides and/or retains the sheet 8. The separator device 3 comprises a driving member 33 for driving and/or controlling the rotation R of at least one of said rollers of the retaining device 31. The separator device 3 is further provided with a sensor device 4 for detecting the pulling apart, the tearing off and/or the separation between two consecutive sheet sections 85 of the sheet 8 between the retaining device 31 and the guide member 32. The apparatus 1 further comprises a control unit 5 that is arranged for controlling the driving member 33 and/or the extruder 6 based on the signals from the sensor device 4.

In a method for converting the previously discussed sheet 8 into a continuous strip 9, the sheet 8 is arranged to be fed from one of the stacks 80 in the feeding direction F into the bite between the two rollers of the retaining device 31. During startup, the sheet 8 is manually torn open to form an initial part of the continuous strip 9 with the zig-zag sections 91 as shown in FIG. 3A. The initial part of the continuous strip 9 is then fed into the bit between the two rollers of the guiding member 32 and subsequently over the infeed roller 60 into the extruder 6. Once the continuous strip 9 is taken in by and/or engaged by the extruder 6, the rest of the continuous strip 9 is automatically pulled into the extruder 6 at the infeed rate of said extruder 6. The pulling on the continuous strip 9 causes the rest of the sheet 8 to be torn open continuously until the stack 80 is depleted or the supply of the sheet 8 is interrupted.

During the converting, subsequent pairs of two consecutive sheet sections 85 are consecutively torn open, pulled apart and/or separated. Each pair of two directly consecutive sheet sections 85 comprises an upstream sheet section 85 and a downstream sheet section 85 in the feeding direction F. The upstream sheet section 85 of each pair is retained by the retaining device 31 while the downstream sheet section 85 is gradually pulled apart from the upstream sheet section 85 along the cut 83 under the pulling action of the extruder 6. The bridges 84 between the downstream sheet section 85 and the upstream sheet section 85 are severed, thus allowing the downstream sheet section 85 to be converted into and/or form the next zig-zag section 91 of the continuous strip 9. Once all the bridges 84 between the downstream sheet section 85 and the upstream sheet section 85 are severed and the sheet sections 85 are solely connected through the alternating connections at the longitudinal edges 81, 82 of the sheet 8, the retaining device 31 releases the upstream sheet section 85 which then becomes the downstream sheet section 85 of a new pair of two directly consecutive sheet sections 85. The new upstream sheet section 85 is again retained by the retaining device 31, after which the steps above are repeated for the new pair of two directly consecutive sheet sections 85.

To accurate control the steps of the method above depending on the actual tearing off, pulling apart and/or separation, the sensor device 4 is located downstream or directly downstream of the retaining device 31 in the feeding direction F for detecting the separation of each pair of two directly consecutive sheet sections 85. The sensor device 4 comprises a first side sensor 41 that is arranged to be near or at the first longitudinal edge 81 of the sheet 8, a central sensor 42 that is arranged to be at or near a centrally located area between the first longitudinal edge 81 and the second longitudinal edge 82 and a second side sensor 43 that is arranged to be at or near the second longitudinal edge 82 of the sheet 8. The sensors 41, 42, 43 may be of any suitable type to detect the presence and/or absence of the sheet sections 85. In this particular example, the sensors 41, 42, 43 are formed by a set of light sources below the sheet 8 and respective photoresistors above the sheet 8 for detecting the light from the light sources. Alternatively, the sensors 41, 42, 43 may be optical sensors arranged solely above the sheet 8 for optically detecting the presence of the sheet sections 85.

Preferably, the sensors 41, 42, 43 are placed on a detection line M extending transverse to the feeding direction F. In particular, the detection line M is arranged to extend parallel or substantially parallel to the cutting direction C. Most preferably, the detection line M is positioned such that the sensors 41, 42, 43 extend at the downstream sheet section 85 to detect the presence and/or absence of said downstream sheet section 85 as a result of the tearing off, pulling apart and/or separation of the two consecutive sheet sections 85.

In the exemplary embodiment as shown in FIG. 3A, three sensors 41, 42, 43 are provided. Alternatively, only a single sensor may be provided, e.g. the central sensor 42 or a single optical sensor with a field of view that covers the entire width of the sheet 8. In a further alternative embodiment, two, four or more sensors (not shown) may be provided, preferably on the same detection line M, to detect the separation even more accurately.

The signals from the one or more sensors 41, 42, 43 are electronically transmitted to the control unit 5, which processes the signals and/or controls the driving member 33 and/or the extruder 6 based on said signals. In particular, the following condition based control can be conceived.

The pulling apart, tearing off and/or separation is shown in different stages in FIGS. 3A-3D. In particular, FIG. 3A shows the situation in which the sheet 8 is retained by the retaining device 31 while the continuous strip 9 is pulled into the extruder 6 in the feeding direction F, thereby causing the sheet section 85 downstream of the detection line M to be gradually pulled apart from the sheet section 85 upstream of the detection line M. The cut 83 between said directly consecutive sheet sections 85 is starting to separate at the side of the first longitudinal edge 81 as the bridges 84 between the cuts 83 are broken. The separation initially exposes the first side sensor 41 only. The first side sensor 41 subsequently transmits a signal to the control unit 5 that is representative of the detection of separation and/or absence of the sheet 8 at the position of the first side sensor 41. The central sensor 42 and the second side sensor 43 are still blocked by the sheet 8.

Figure 3B:
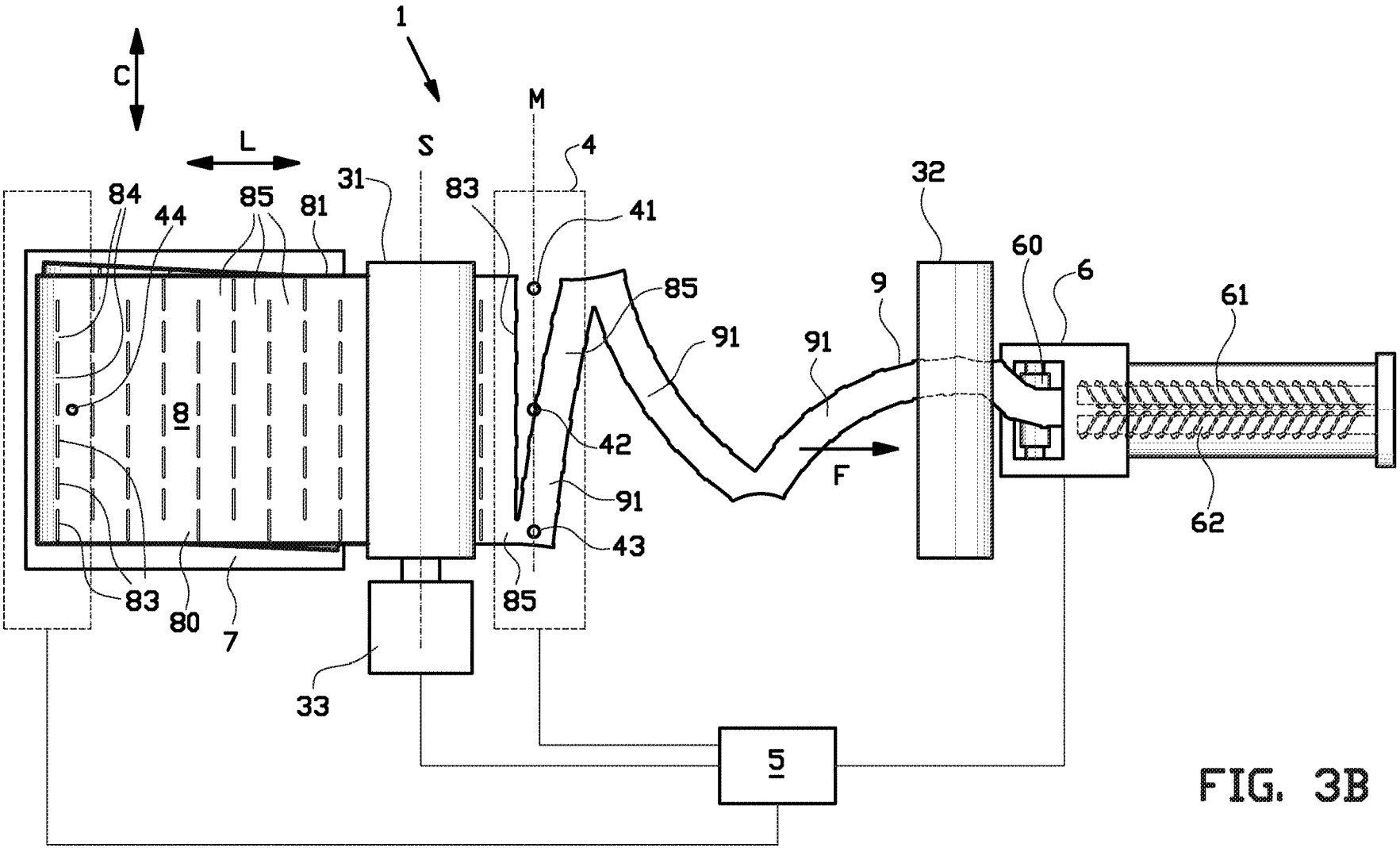

FIG. 3B shows the situation in which the retaining device 31 still retains the sheet 8 as the downstream sheet section 85 is pulled apart from the upstream sheet section 85 further, thereby separating the directly consecutive sheet sections 85 further and exposing both the first side sensor 41 and the central sensor 42. Both the first side sensor 41 and the central sensor 42 now simultaneously transmit a signal to the control unit 5 that is representative of the detection of separation and/or absence of the sheet 8 at the positions of the first side sensor 41 and the central sensor 42. Only the second side sensor 43 is still blocked by the sheet 8. The control unit 5 derives from this state that the downstream sheet section 85 has sufficiently separated from the upstream sheet section 85 to form the next zig-zag section 91 of the continuous strip 9 and controls the driving member 33 to release the sheet 8 from the retaining device 31 in the feeding direction F.

Figure 3C:
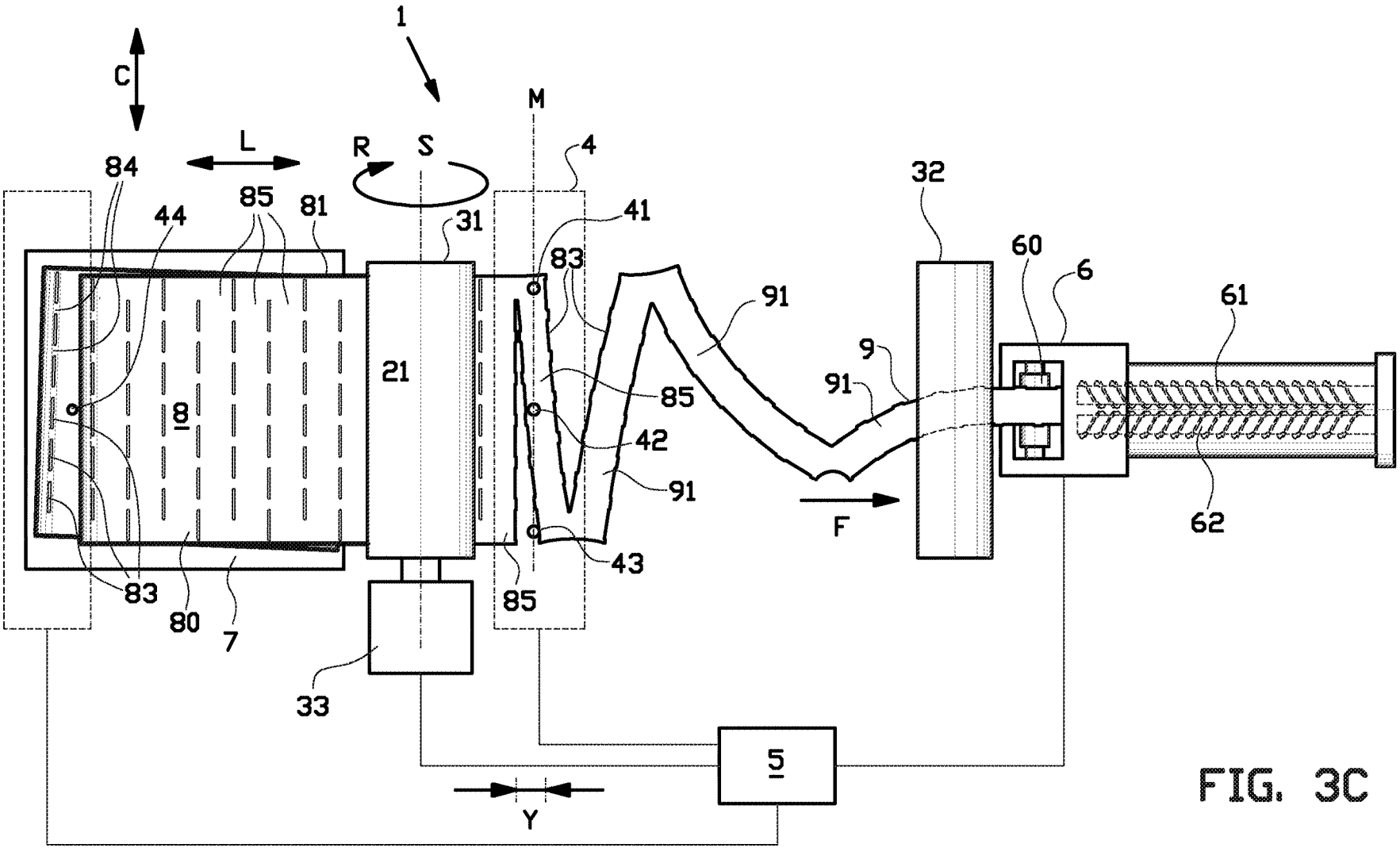

FIG. 3C shows the situation after the driving member 33 has rotated the retaining device 31 in a rotational direction R about the rotation axis S to advance the sheet 8 over a predetermined feeding distance Y in the feeding direction F, preferably substantially equivalent or equal to the width of one sheet section 85 in the feeding direction F prior to its separation. Consequently, the upstream sheet section 85 has now moved over the feeding distance Y and has taken the place that was previously occupied by the downstream sheet section 85 and hence becomes the downstream sheet section 85 of a new pair of two directly consecutive sheet sections 85 in a next cycle of the detection. After the advancement, the sheet 8 is again retained by the retaining device 31.

Figure 3D:
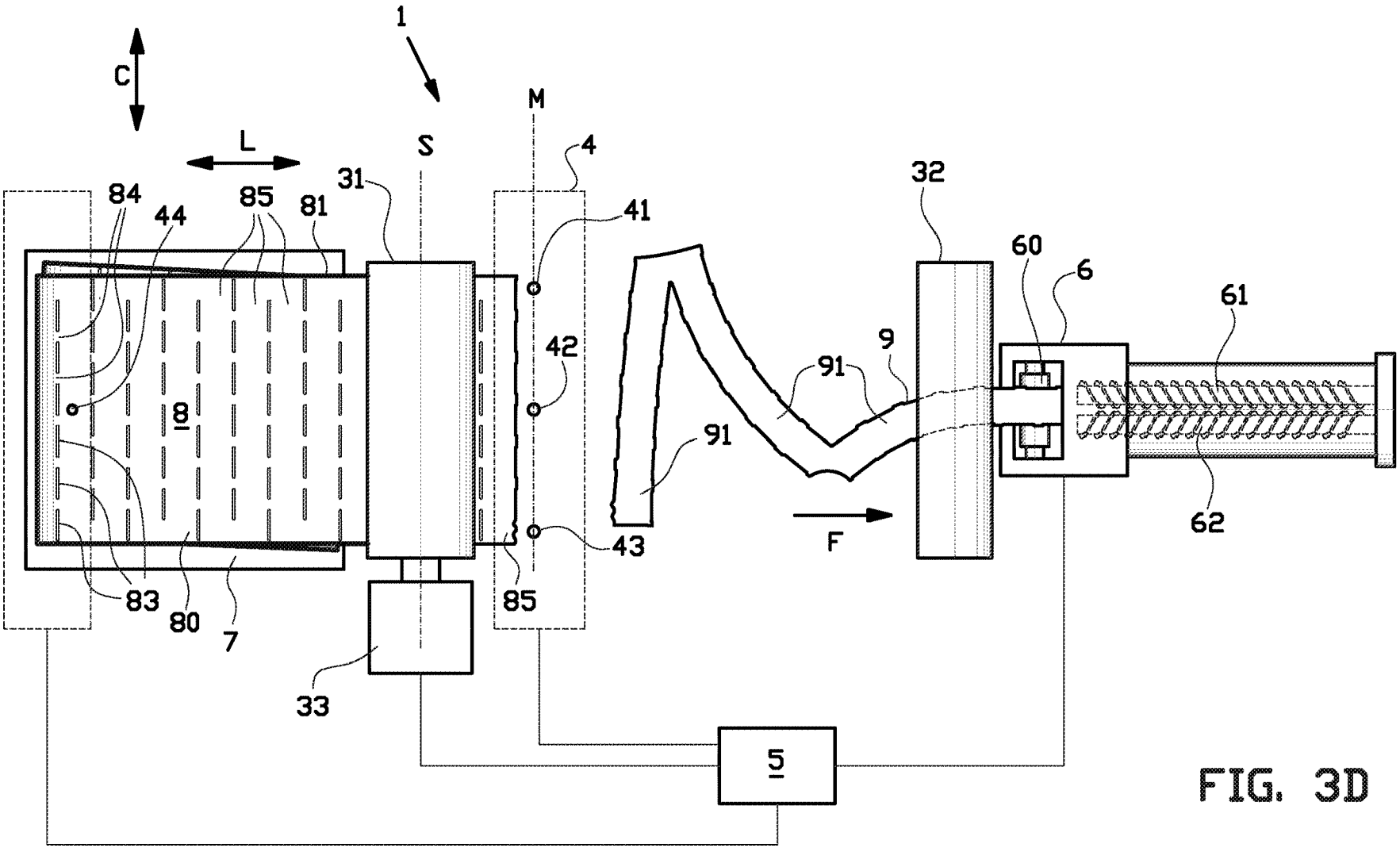

Optionally, during the advancing of the sheet 8, the control unit 5 monitors whether the second side sensor 43 continuously detects the presence of the sheet 8. This is indicative of an uninterrupted connection between the consecutive sheet sections 85. In FIG. 3D, the situation is shown in which the second side sensor 43 detects a separation between the downstream sheet section 85 and the upstream sheet section 85 simultaneously with the first side sensor 41 and the central sensor 42. In other words, all sensors 41-43 on the detection line M simultaneously detect separation. In this situation the control unit 5 concludes that the downstream sheet section 85 has been ripped off completely from the upstream sheet section 85 and that the sheet 8 and the continuous strip 9 are no longer interconnected and/or continuous. The control unit 5 can take appropriate action, e.g. stopping the process and/or sending an alarm signal to an operator.

As long as the process is continuous and/or the sheet 8 and continuous strip 9 are uninterrupted, the steps of FIGS. 3A-3C are repeated in a zig-zag and/or back-and-forth fashion along the detection line M.

Preferably, the control unit 5 is electronically connected to the extruder for controlling the infeed rate of the extruder 6 based on the detection signals of the sensors 41-43 in the sensor device 4.

Optionally, a stack sensor 44 may be provided upstream of the retaining device 31 for early detection of an interruption in the sheet 8 before it is fed towards the retaining device 31. Preferably, the stack sensor 44 is located at or near the carrier 7 for detecting the presence and/or absence of the sheet 8 at said carrier 7. In particular, the stack sensor 44 can detect that the stack 80 is depleted so that early action may be taken to replace the stack 80 with another stack 80.

FIG. 4 shows a further alternative apparatus 201 according to a third embodiment of the invention. The apparatus 201 in FIG. 4 differs from the apparatuses 1, 101 as shown in FIGS. 1 and 2 in that the cutting device 202 forms part of the separator device 203. In particular, the cutting device 202 forms part of the retaining device 231.

As further shown in FIGS. 5A-5D, the cutting device 202 is further adapted for cutting under a cutting direction C that is oblique with respect to the longitudinal direction L of the sheet 208 and/or the feeding direction F. It will be apparent to one skilled in the art that this adaptation is optional and that the cutting direction C may also be perpendicular to the longitudinal direction L and/or the feeding direction F, similar to FIGS. 3A-3D. The difference in cutting direction C is merely shown to illustrate the variations that can be applied to each of the embodiments of the invention. It will further be apparent to one skilled in the art that alternative cutting means, e.g. disc cutters, may be used instead of the cutting device 2, provided that they are suitable for creating the previously discussed sections 81.

Figure 5A:
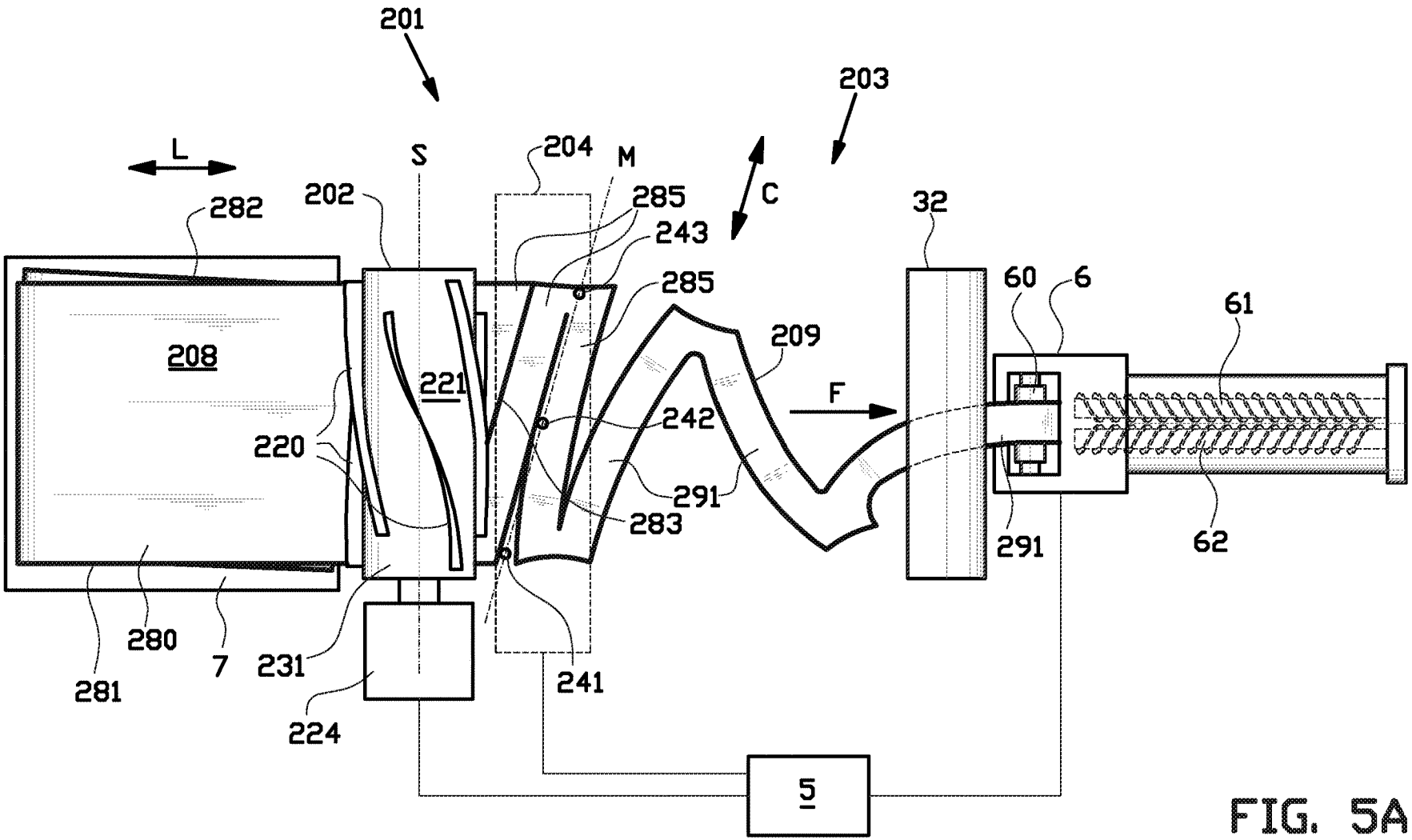
FIGS. 5A-5D show top views of the apparatus according to FIG. 4 during several steps of converting the sheet into the continuous strip.
Figure 5B:
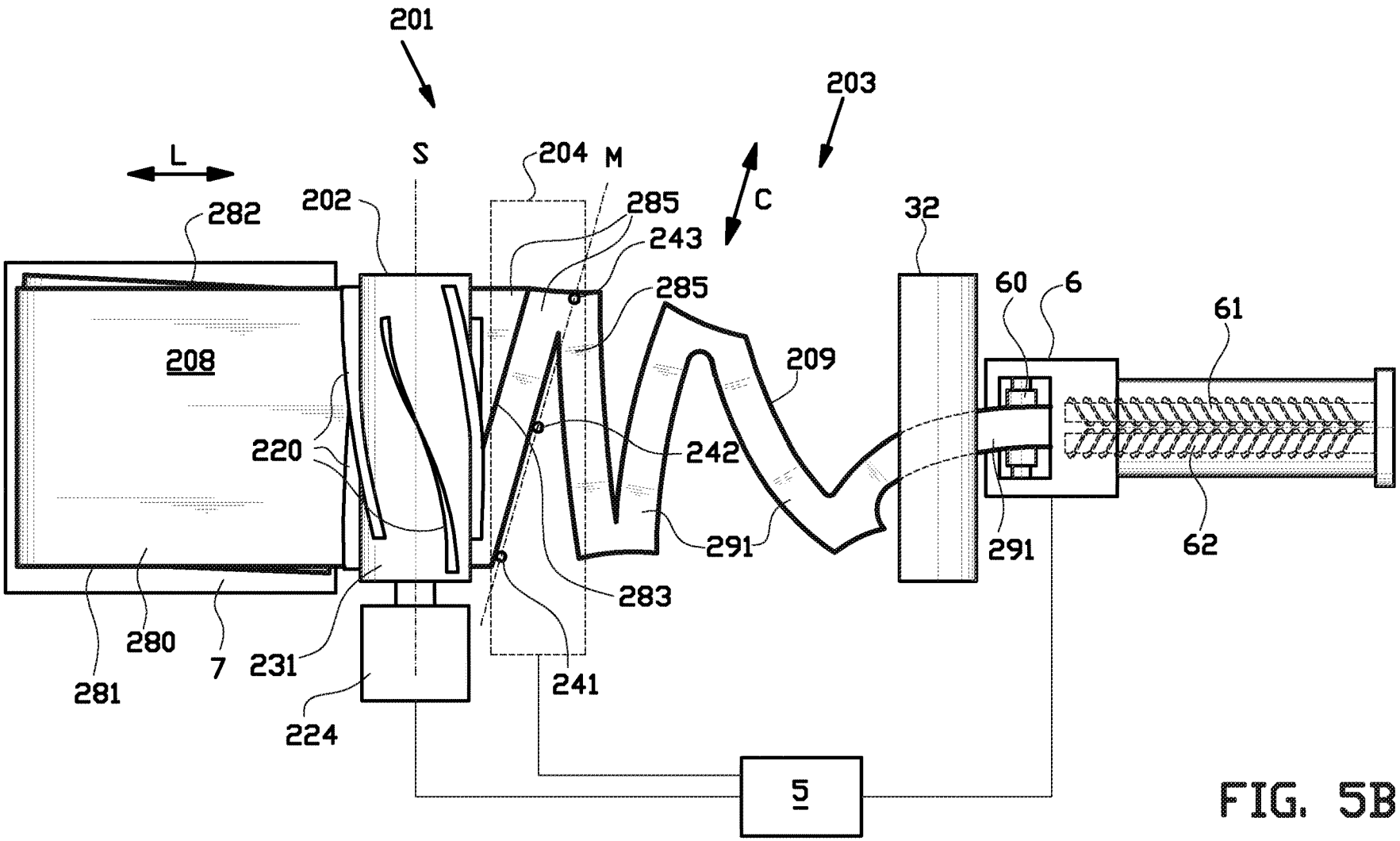
Figure 5C:
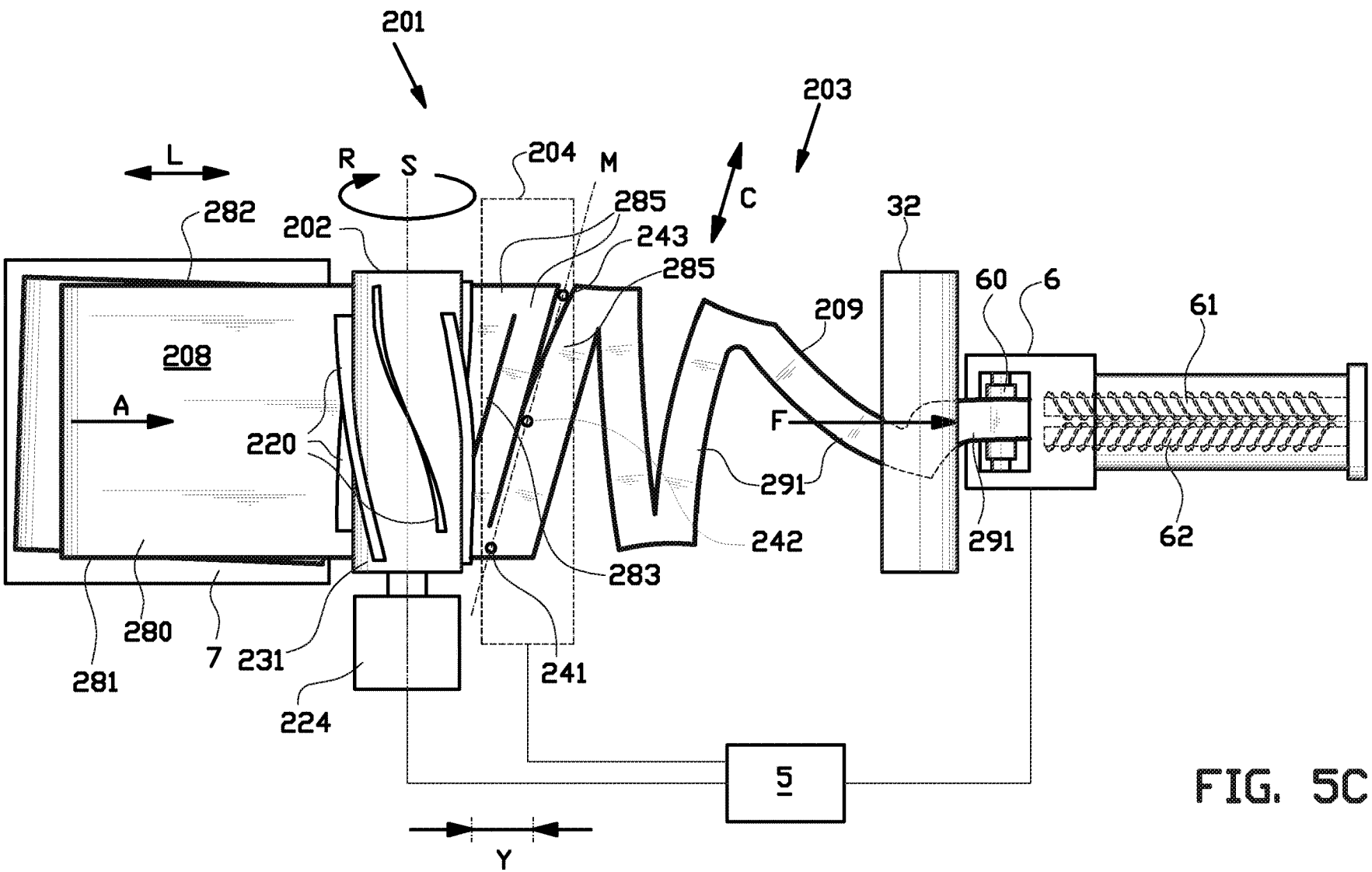
Figure 5D:
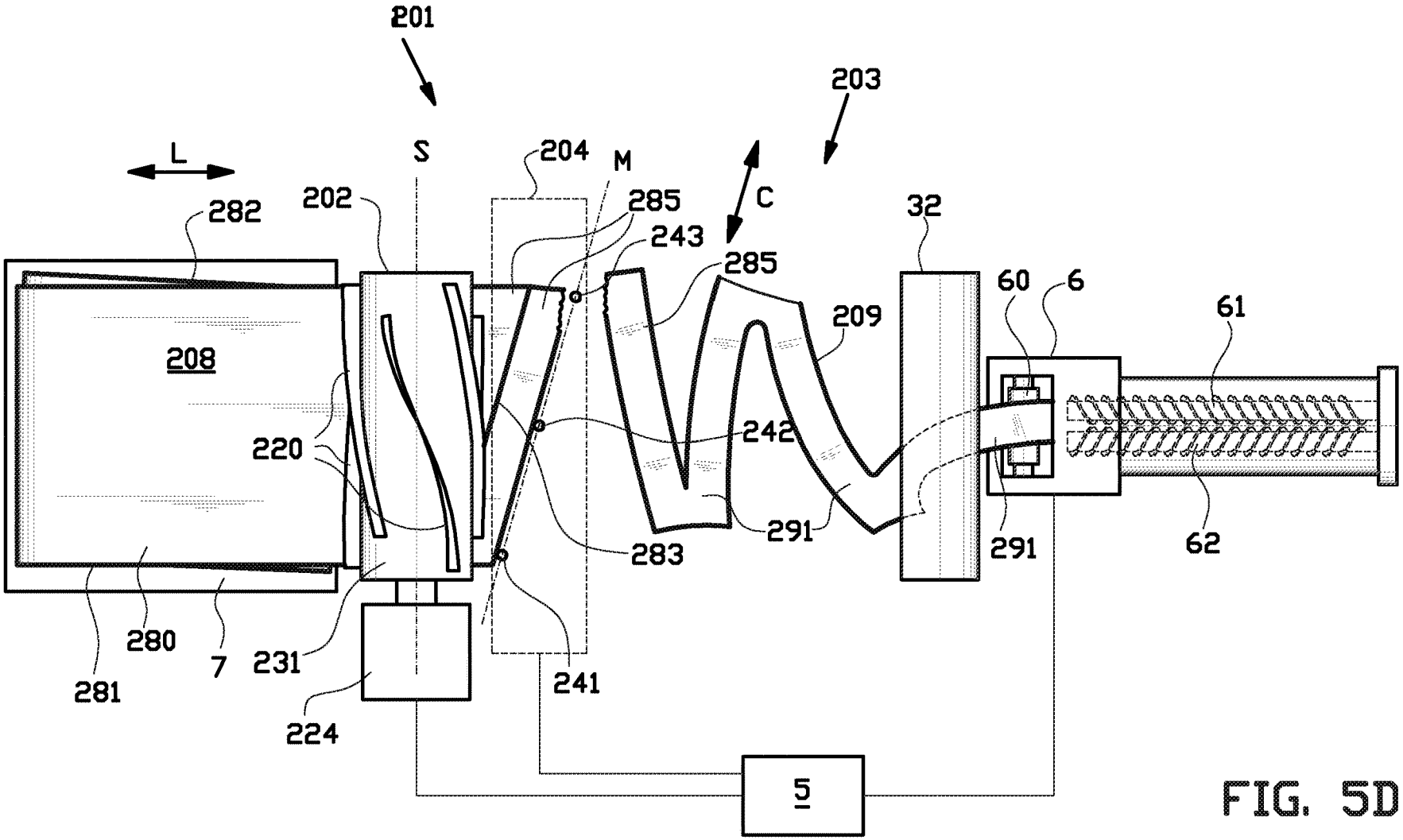
Figure 6:
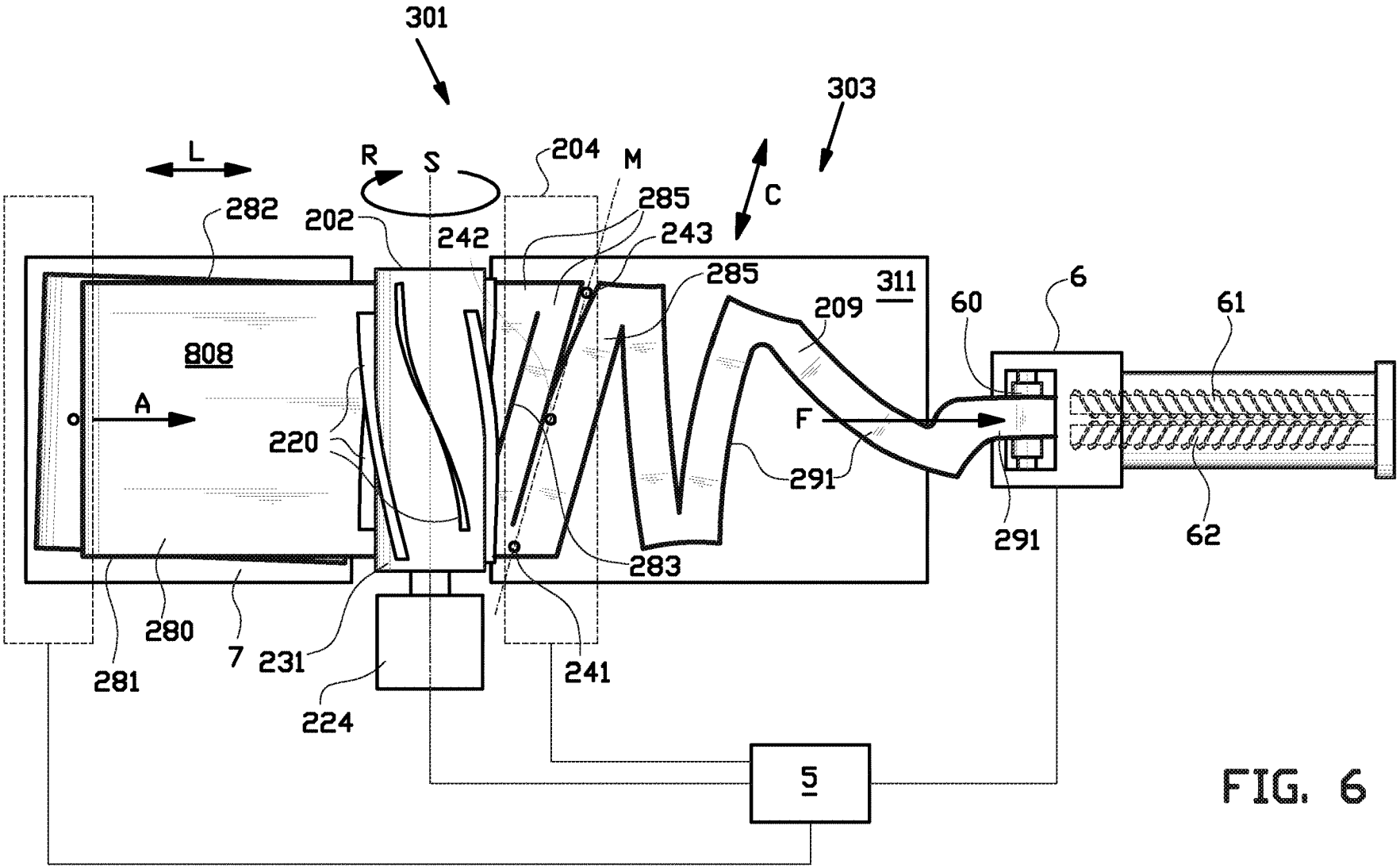
FIG. 6 shows a top view of a further alternative apparatus according to a fourth embodiment of the invention.

FIG. 6 shows a further alternative apparatus 301 according to a fourth embodiment of the invention that is substantially the same as the apparatus 201 of FIG. 5A. The apparatus 301 in FIG. 6 differs from the apparatus 201 as shown in FIG. 5A in that the guiding members 232 downstream of the sensors 241, 242, 243 are replaced by a support member 311 extending between the cutting device 202 and the extruder 6 for supporting the sheet sections 285 and/or the zig-zag sections 291 downstream of the cutting device 202.

Figure 7:
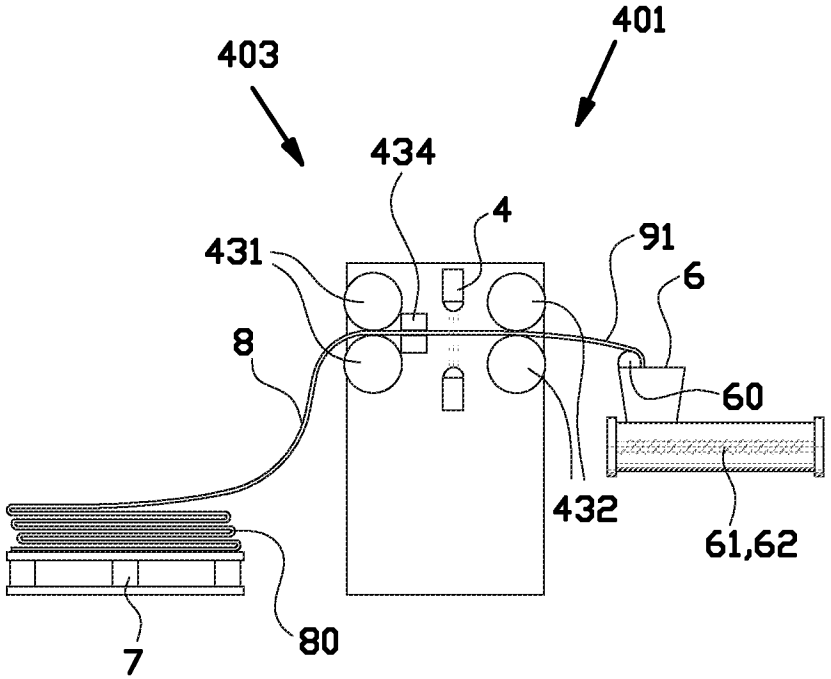
FIG. 7 shows a side view of a further alternative apparatus according to a fifth embodiment of the invention.

In the previously discussed embodiments of the apparatus 1, 101, 201, 301, the retaining device 31 and/or the cutting device 202 is arranged to hold the sheet sections 85, 285 until a control signal is received from the control unit 5. FIG. 7 shows a further alternative apparatus 401 according to a fifth embodiment of the invention, which apparatus 401 differs from the previously discussed apparatuses 1, 101, 201, 301 in that its separator device 403 is additionally provided with a separate retaining device 434 for retaining the sheet 8 as close as possible to the detection line M. The retaining device 434 is preferably located directly upstream of the detection line M to retain the sheet section 85 of the sheet 8 that is directly upstream of said detection line M. The retaining device 434 can be placed parallel to the detection line M so that the sheet section 85 directly upstream of the detection line M can be held reliably while the sheet section 85 directly downstream of the detection line M is torn off in the feeding direction F. In the presence of the retaining device 434, the previously discussed retaining device 31 merely functions as a guide member 431 upstream of the retaining device 434, similar to the guide members 432 downstream of the retaining device 434.

Figure 8:
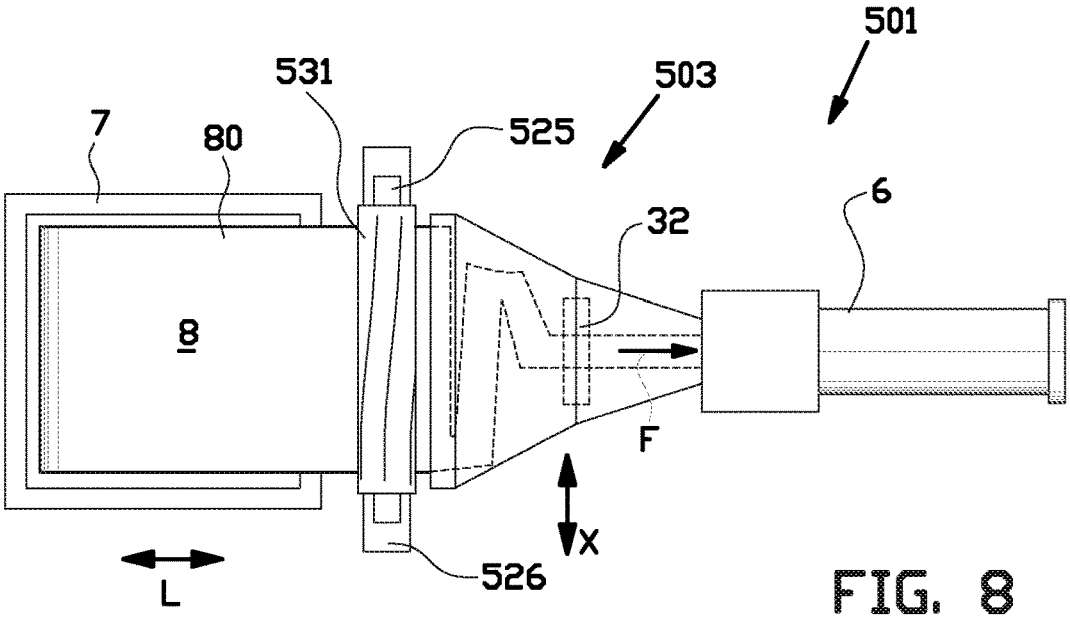
FIG. 8 shows a top view of a further alternative apparatus according to a sixth embodiment of the invention.

FIG. 8 shows a further alternative apparatus 501 according to a sixth embodiment of the invention. The apparatus 501 according to the sixth embodiment essentially features a separator device 503 like the previously discussed separator devices 3, 203, 303, 403 for separating a sheet 8 from a stack 80 into a continuous strip 9. The apparatus 501 according to the sixth embodiment of the invention differs from the previously discussed embodiments in that the retaining device or guide member 531 upstream of the sensor device 4 is arranged on a carriage 525 that is movable over a rail 526 in a translation direction X transverse and/or perpendicular to the feeding direction F. Hence, the position of the retaining device 31, 231 and/or the guide members 531 can be adjusted in the translation direction X to follow width variations or irregularities in the width of the sheet 8 or inaccurate stacking of the layers in the stack 80 during the feeding in the feeding direction F. The sheet 8 can thus be fed and/or cut more accurately in the separator device.

Figure 9:
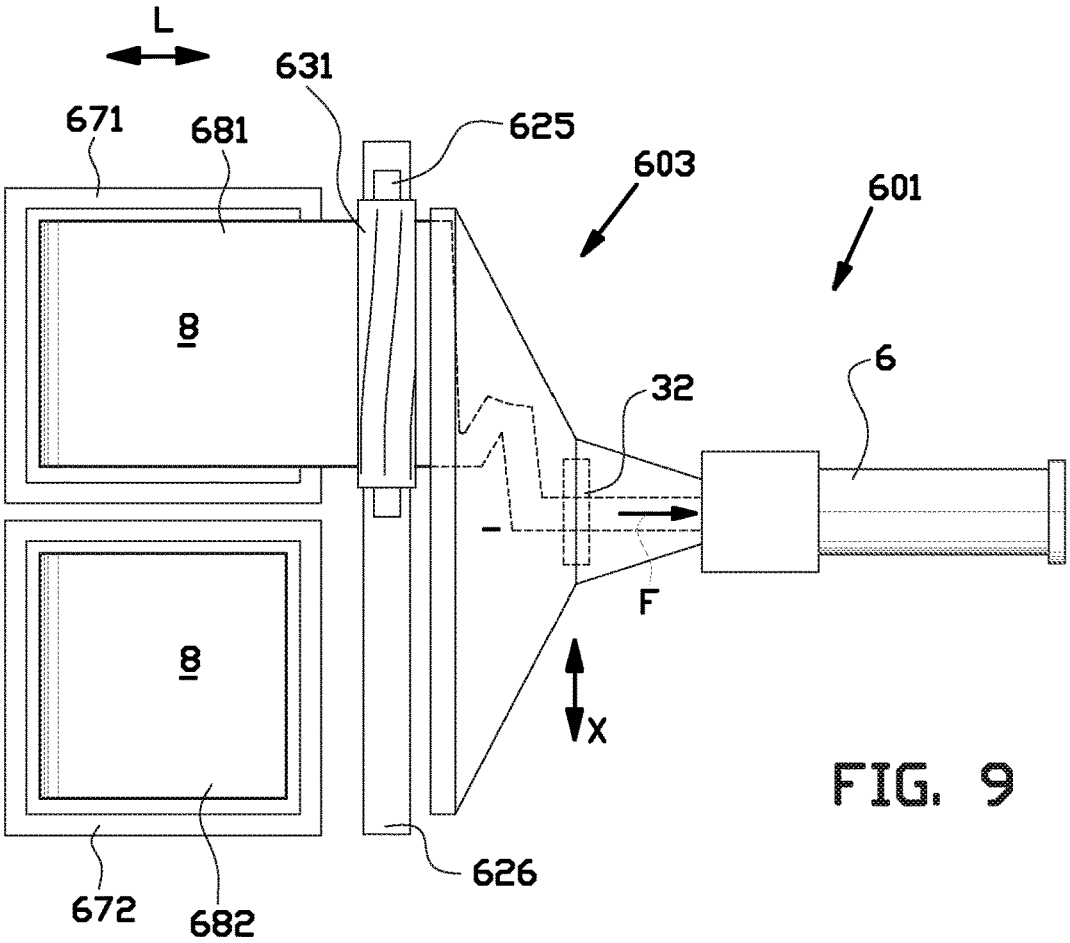
FIG. 9 shows a top view of a further alternative apparatus according to a seventh embodiment of the invention.

FIG. 9 shows a further alternative apparatus 601 according to a seventh embodiment of the invention, featuring a similar carriage 625 and rail 626 as in the previously discussed embodiment. The sheet 8 can be alternately fed into the separation device 603 from a first stack 681 and a second stack 682 which are placed adjacent to each other in the translation direction X on a first carrier 671 and a second carrier 672, respectively. The rail 626 extends in the translation direction X in front of both stacks 681, 681 in the feeding direction F to allow the carriage 625 to be positioned alternately in front of a first stack 681 on a first carrier 671 and a second stack 682 on a second carrier 672 in said feeding direction F. Thus, when the first stack 681 is depleted, the carriage 625 can be translated towards the second stack 682 for feeding in the sheet 8 of said second stack 682 while the first stack 681 is replaced with a new stack. Hence, the interruption of the feeding-in can be kept as short as possible.

The depletion of the first stack 681 may be detected by a stack sensor like the stack sensor 44 as shown in FIGS. 3A-3D. Alternatively, the driving member 33, 224 may be fitted with a torque sensor detecting the torque with and without the presence of a sheet 8. In a further alternative embodiment, the presence of a sheet 8 may be detected by a force sensor detecting the displacement of the retaining device 31, 231 and/or the guide members 431 as a result of the sheet 8.

In the embodiment of FIGS. 8 and 9, the area of the separator devices 503, 603 is shielded by a housing to prevent the operator from reaching into any hazardous areas. In this exemplary embodiment, the housing tapers in the feeding direction F to direct the continuous strip 9 towards the infeed of the extruder 6. The housing does however not significantly change the principle of operation of the previously discussed separation devices 3, 203, 303, 403.

Figure 10A:
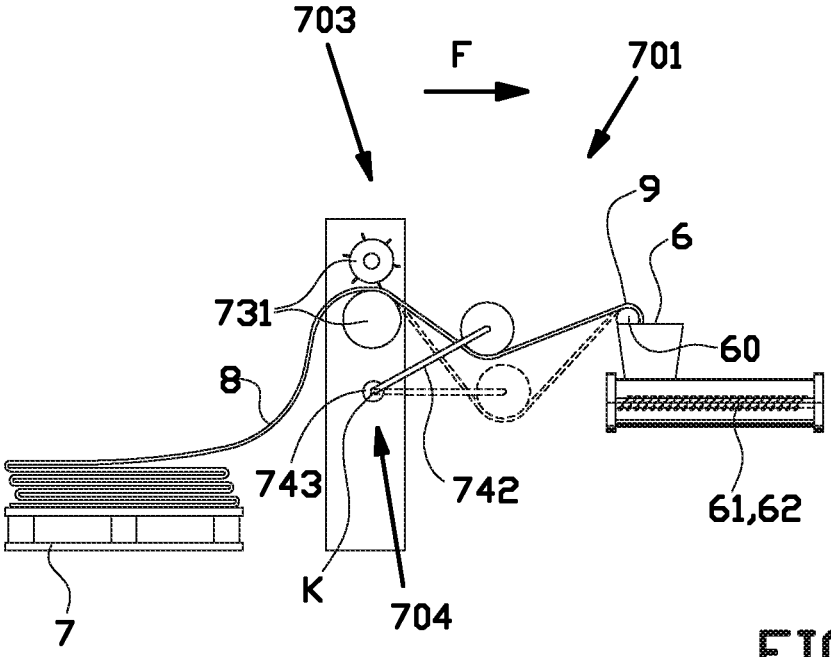
FIGS. 10A, 10B and 10C show side views of further alternative apparatuses according to an eighth, ninth and tenth embodiment of the invention.
Figure 10B:
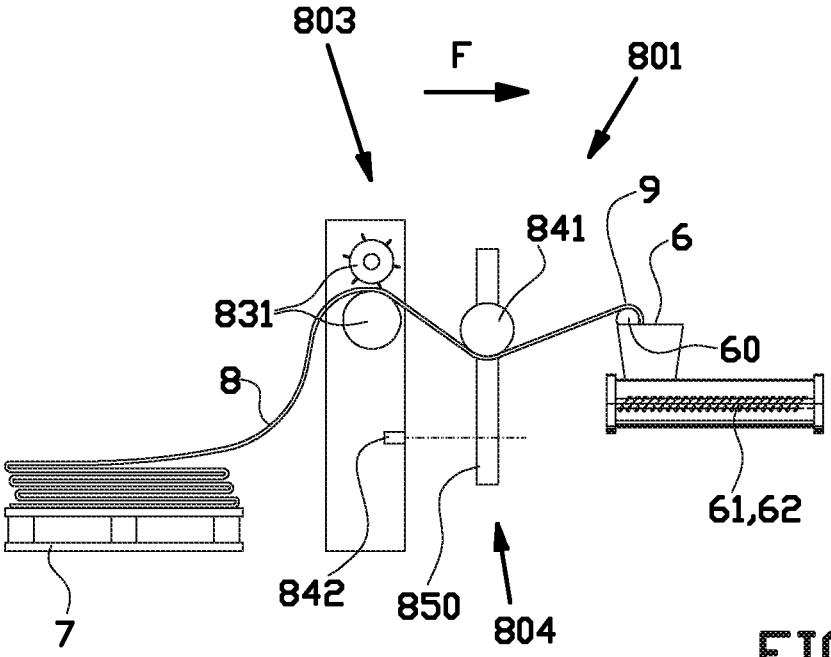
Figure 10C:
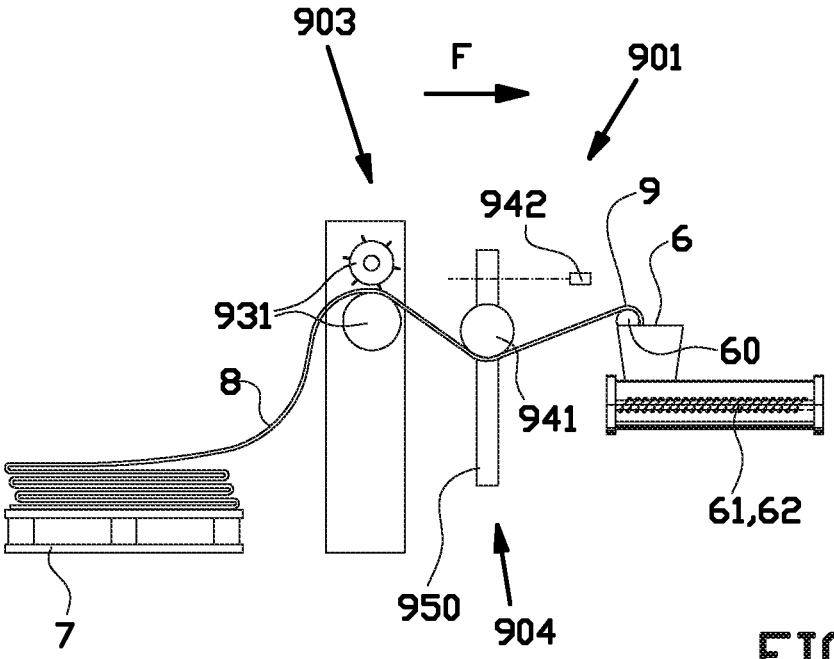

FIGS. 10A, 10B and 10C show further alternative apparatuses 701, 801, 901 with respective separator devices 703, 803, 903 according to an eighth, ninth and tenth embodiment of the invention. The separator devices 703, 803, 903 have in common that the continuous strip 9 is allowed to slack between the retaining device 731, 831, 931—which can be any of the previously discussed retaining devices 31, 231, 431—and the extruder 6. At said slacking of the continuous strip 9, the sensor devices 704, 804, 904 of each separator device 703, 803, 903 are provided with a dancer roller 741, 841, 941 that is arranged to push down onto the continuous strip 9 with its weight or mass. The retaining of the sheet 8 by the retaining device 731, 831, 931 in combination with the pulling of the extruder 6 causes the dancer roller 741, 841, 941 to move upwards with the continuous strip 9. The pulling apart of the sheet sections of the sheet 8 causes the dancer roller 741, 841, 941 to move downwards with the continuous strip 9. The eighth, ninth and tenth embodiments of the invention utilize the movement and/or position of the dancer roller 741, 841, 941 as an indicator for the pulling apart.

In the eighth embodiment as shown in FIG. 10A, the dancer roller 741 is mounted on an arm 742 that is rotatable about an arm axis K. The sensor device 704 further comprises an angular displacement sensor 743 that is arranged to detect the angular displacement of the arm 742 and/or the dancer roller 741 about said arm axis K.

In the ninth and tenth embodiment, the dancer roller 841, 941 is linearly guided by a guide 850, 950 and the sensor device 804, 904 further comprises respective sensors 842, 942 for detecting the presence and/or passing of the dancer roller 841, 941 in or through a detection position. The sensors 842, 942 may be photoresistors. The detection position in the ninth embodiment is near or in the lower position of the dancer roller 841 during or after the pulling apart. The detection position in the tenth embodiment is near or in the upper position of the dancer roller 941 prior to the pulling apart.

It will be apparent to one skilled in the art that the sensors 743, 842, 942 can be used alone or in combination to get more reliable information about the position and/or movement of the dancer roller 741, 841, 941. Furthermore, the arm 742 and the guide 950 are interchangeable.

Similarly to the previously discussed embodiment, the retaining device 731, 831, 931, the extruder 6 and the sensor device 704, 804, 904 are all electronically connected to the control unit 5. The control unit 5 processes the signals from the sensor device 704, 804, 904 and controls, based on the detected movement and/or position of the dancer roller 741, 841, 941, whether the pulling apart has correctly taken place and whether it is appropriate to release and advance the sheet 8 for a next cycle of the pulling apart. When the dancer roller 741, 841, 941 does not move upwards after the downwards movement or when the dancer roller 741, 841, 941 does not move downwards after the upward movement, this is indicative of an interruption in the continuous strip 9. Consequently, the pulling apart is stopped and/or an alarm signal is given so that an operator may take appropriate action.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

In summary, the invention relates to an apparatus and a method for converting a sheet into a continuous strip, wherein the sheet has a sequence of cuts extending in a cutting direction transversely across the sheet with respect to the longitudinal direction to form a plurality of interconnected sheet sections, wherein the continuous strip has zig-zag sections, wherein the sheet sections are arranged to be pulled apart in a feeding direction to form the zig-zag sections, wherein the apparatus comprises a separator device with a retaining device for retaining an upstream sheet section with respect to a consecutive downstream sheet section in the feeding direction and a sensor device for detecting the pulling apart of the downstream sheet section from the upstream sheet section.

The invention claimed is:

1. An apparatus for converting a sheet of elastomeric material into a continuous strip, wherein the sheet has a longitudinal direction, a first longitudinal edge, a second longitudinal edge and a sequence of cuts extending in a cutting direction transversely across the sheet with respect to the longitudinal direction, wherein the cuts in the sequence alternately extend from one of the longitudinal edges towards and terminate short of the other of the longitudinal edges to form a plurality of interconnected sheet sections, wherein the continuous strip has a plurality of interconnected zig-zag sections, wherein the sheet sections are arranged to be pulled apart in a feeding direction to form the zig-zag sections of the continuous strip, wherein the apparatus comprises a separator device that is arranged for receiving the sheet with the longitudinal direction thereof parallel to the feeding direction, wherein the separator device comprises a retaining device for retaining an upstream sheet section with respect to a consecutive downstream sheet section in the feeding direction, and a sensor device for detecting the pulling apart of the downstream sheet section from the upstream sheet section, wherein the sensor device comprises two or more sensors arranged for detecting the pulling apart of the downstream sheet section from the upstream sheet section, wherein said two or more sensors comprise at least a first side sensor, and wherein the apparatus further comprises a control unit that is electronically connected to the retaining device and the first side sensor for controlling the retaining device to retain the upstream sheet section until the first side sensor detects the pulling apart of the downstream sheet section from the upstream sheet section.

2. The apparatus according to claim 1, wherein the two or more sensors comprise one or more central sensors that are arranged for detecting the pulling apart of the downstream sheet section from the upstream sheet section at a central area of the sheet between the longitudinal edges.

3. The apparatus according to claim 2, wherein the retaining device is arranged for retaining the upstream sheet section when none of the two or more sensors detects the pulling apart of the downstream sheet section from the upstream sheet section.

4. The apparatus according to claim 3, wherein the control unit is arranged for controlling the retaining device to retain the upstream sheet section until one of the two side sensors and at least one of the one or more central sensors detects the pulling apart of the downstream sheet section from the upstream sheet section.

5. The apparatus according to claim 4, wherein the control unit is arranged for controlling the retaining device to release the upstream sheet section when one of the two side sensors is the only sensor that has not yet detected the pulling apart.

6. The apparatus according to claim 3, wherein the control unit is further arranged for controlling the retaining device to retain the upstream sheet section if both side sensors and the one or more central sensors simultaneously detect the pulling apart.

7. The apparatus according to claim 2, wherein the retaining device is arranged for releasing the upstream sheet section when at least one of the two or more sensors detects the pulling apart of the downstream sheet section from the upstream sheet section.

8. The apparatus according to claim 1, wherein the first side sensor is arranged for detecting the pulling apart of the downstream sheet section from the upstream sheet section at or near the first longitudinal edge of the sheet.

9. The apparatus according to claim 8, wherein the two or more sensors comprises a second side sensor that is arranged for detecting the pulling apart of the downstream sheet section from the upstream sheet section at or near the second longitudinal edge of the sheet.

10. The apparatus according to claim 1, wherein the control unit is further arranged for controlling the retaining device to release the sheet to allow the upstream sheet section to advance over a predetermined feeding distance in the feeding direction, wherein the control unit is arranged for controlling the retaining device to again retain the sheet once the upstream sheet section has advanced over the predetermined feeding distance.

11. The apparatus according to claim 10, wherein the predetermined feeding distance is equal to the width of a sheet section in the feeding direction.

12. The apparatus according to claim 1, wherein the apparatus further comprises an extruder that has a controllable infeed rate, wherein the control unit is electronically connected to the extruder for controlling the infeed rate of the extruder based on the detection of the pulling apart by the two or more sensors.

13. The apparatus according to claim 1, wherein the sensor device comprises one or more central sensors that are arranged for detecting the pulling apart of the downstream sheet section from the upstream sheet section at a central area of the sheet between the longitudinal edges, wherein the two or more sensors are arranged on a detection line that extends parallel to the cutting direction.

14. The apparatus according to claim 1, wherein the apparatus comprises a cutting device that is arranged for receiving the sheet with the longitudinal direction thereof parallel to the feeding direction and for cutting transversely across the sheet with respect to the feeding direction to create the sequence of cuts.

15. The apparatus according to claim 14, wherein the cutting device is arranged upstream of the separator device, wherein the apparatus comprises one or more carriers for storing the sheet with cut sheet sections between the cutting device and the separator device.

16. The apparatus according to claim 14, wherein the separator device comprises the cutting device.

17. The apparatus according to claim 16, wherein the retaining device comprises the cutting device.

18. The apparatus according to claim 17, wherein the cutting device comprises one or more blades extending in to the cutting direction.

19. The apparatus according to claim 16, wherein the retaining device is arranged downstream of the cutting device in the feeding direction.

20. The apparatus according to claim 16, wherein the cutting device is arranged for creating a next cut in the sequence of cuts with each release of the retaining device.

21. An apparatus for converting a sheet of elastomeric material into a continuous strip, wherein the sheet has a longitudinal direction, a first longitudinal edge, a second longitudinal edge and a sequence of cuts extending in a cutting direction transversely across the sheet with respect to the longitudinal direction, wherein the cuts in the sequence alternately extend from one of the longitudinal edges towards and terminate short of the other of the longitudinal edges to form a plurality of interconnected sheet sections, wherein the continuous strip has a plurality of interconnected zig-zag sections, wherein the sheet sections are arranged to be pulled apart in a feeding direction to form the zig-zag sections of the continuous strip, wherein the apparatus comprises a separator device that is arranged for receiving the sheet with the longitudinal direction thereof parallel to the feeding direction, wherein the separator device comprises a retaining device for retaining an upstream sheet section with respect to a consecutive downstream sheet section in the feeding direction and a sensor device for detecting the pulling apart of the downstream sheet section from the upstream sheet section, wherein the sensor device comprises a first side sensor that is arranged for detecting the pulling apart of the downstream sheet section from the upstream sheet section at or near the first longitudinal edge of the sheet, wherein the sensor device comprises a second side sensor that is arranged for detecting the pulling apart of the downstream sheet section from the upstream sheet section at or near the second longitudinal edge of the sheet, wherein the sensor device comprises one or more central sensors that are arranged for detecting the pulling apart of the downstream sheet section from the upstream sheet section at a central area of the sheet between the longitudinal edges, wherein the apparatus further comprises a control unit, wherein the control unit is electronically connected to the retaining device, the first side sensor, the one or more central sensors and the second side sensor for controlling the retaining device to retain the upstream sheet section until one of the two side sensors detects the pulling apart of the downstream sheet section from the upstream sheet section.

22. An apparatus for converting a sheet of elastomeric material into a continuous strip, wherein the sheet has a longitudinal direction, a first longitudinal edge, a second longitudinal edge and a sequence of cuts extending in a cutting direction transversely across the sheet with respect to the longitudinal direction, wherein the cuts in the sequence alternately extend from one of the longitudinal edges towards and terminate short of the other of the longitudinal edges to form a plurality of interconnected sheet sections, wherein the continuous strip has a plurality of interconnected zig-zag sections, wherein the sheet sections are arranged to be pulled apart in a feeding direction to form the zig-zag sections of the continuous strip, wherein the apparatus comprises a separator device that is arranged for receiving the sheet with the longitudinal direction thereof parallel to the feeding direction, wherein the separator device comprises a retaining device for retaining an upstream sheet section with respect to a consecutive downstream sheet section in the feeding direction and a sensor device for detecting the pulling apart of the downstream sheet section from the upstream sheet section, wherein the sensor device comprises a side sensor that is arranged for detecting the pulling apart of the downstream sheet section from the upstream sheet section at or near the second longitudinal edge of the sheet, and wherein the apparatus further comprises a control unit that is electronically connected to the retaining device and the side sensor for controlling the retaining device to retain the upstream sheet section until the side sensor detects the pulling apart of the downstream sheet section from the upstream sheet section.

23. An apparatus for converting a sheet of elastomeric material into a continuous strip, wherein the sheet has a longitudinal direction, a first longitudinal edge, a second longitudinal edge and a sequence of cuts extending in a cutting direction transversely across the sheet with respect to the longitudinal direction, wherein the cuts in the sequence alternately extend from one of the longitudinal edges towards and terminate short of the other of the longitudinal edges to form a plurality of interconnected sheet sections, wherein the continuous strip has a plurality of interconnected zig-zag sections, wherein the sheet sections are arranged to be pulled apart in a feeding direction to form the zig-zag sections of the continuous strip, wherein the apparatus comprises a separator device that is arranged for receiving the sheet with the longitudinal direction thereof parallel to the feeding direction, wherein the separator device comprises a retaining device for retaining an upstream sheet section with respect to a consecutive downstream sheet section in the feeding direction and a sensor device for detecting the pulling apart of the downstream sheet section from the upstream sheet section, wherein the sensor device comprises one or more central sensors that are arranged for detecting the pulling apart of the downstream sheet section from the upstream sheet section at a central area of the sheet between the longitudinal edges, and wherein the apparatus further comprises a control unit that is electronically connected to the retaining device and the one or more central sensors for controlling the retaining device to retain the upstream sheet section until the one or more central sensors detect the pulling apart of the downstream sheet section from the upstream sheet section.

24. A method for converting a sheet of elastomeric material into a continuous strip with the use of the apparatus according to claim 1, wherein the method comprises the steps of: creating the sequence of cuts in the sheet to form the interconnected sheet sections, receiving the sheet in the separator device with the longitudinal direction of the sheet parallel to the feeding direction, pulling the sheet sections apart in the feeding direction while retaining an upstream sheet section with respect to a consecutive downstream sheet section in the feeding direction to form the zig-zag sections of the continuous strip, and detecting the pulling apart of the downstream sheet section from the upstream sheet section with the sensor device that is located downstream of the retaining device in the feeding direction.

* * * * *